US009725874B2

(12) United States Patent
Meguriya et al.

(10) Patent No.: US 9,725,874 B2
(45) Date of Patent: Aug. 8, 2017

(54) AREA LIMITING EXCAVATION CONTROL SYSTEM FOR CONSTRUCTION MACHINES

(71) Applicant: Hitachi Construction Machinery Co., Ltd., Bunkyo-ku, Tokyo (JP)

(72) Inventors: Shuuichi Meguriya, Ishioka (JP); Yasuhiko Kanari, Kasumigaura (JP); Takahiko Kurose, Moriya (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/025,357

(22) PCT Filed: Nov. 13, 2014

(86) PCT No.: PCT/JP2014/080104

§ 371 (c)(1),
(2) Date: Mar. 28, 2016

(87) PCT Pub. No.: WO2015/151328

PCT Pub. Date: Oct. 8, 2015

(65) Prior Publication Data

US 2016/0215475 A1 Jul. 28, 2016

(30) Foreign Application Priority Data

Mar. 31, 2014 (JP) ..... 2014-070782

(51) Int. Cl.
*G06F 7/70* (2006.01)
*G06F 19/00* (2011.01)
(Continued)

(52) U.S. Cl.
CPC ..... *E02F 3/437* (2013.01); *E02F 3/32* (2013.01); *E02F 3/425* (2013.01); *E02F 9/2004* (2013.01);
(Continued)

(58) Field of Classification Search
CPC . E02F 3/32; E02F 3/425; E02F 9/2004; E02F 9/2225; E02F 9/2285; E02F 9/265
(Continued)

(56) References Cited

U.S. PATENT DOCUMENTS 5,835,874 A 11/1998 Hirata et al.

FOREIGN PATENT DOCUMENTS

JP 2-47432 A 2/1990
JP 2-221527 A 9/1990
(Continued)

OTHER PUBLICATIONS

International Search Report (PCT/ISA/210) issued in PCT Application No. PCT/JP2014/080104 dated Feb. 17, 2015 with English translation (3 pages).
(Continued)

*Primary Examiner* — Maceeh Anwari
(74) *Attorney, Agent, or Firm* — Crowell & Moring LLP

(57) ABSTRACT

An area limiting excavation control system for construction machines including a control unit (9) that performs area limiting control by controlling at least one of a plurality of hydraulic cylinders (3*a*, 3*b*, 3*c*) on the basis of a posture and a position of each of a boom (1*a*), an arm (1*b*), and a bucket (1*c*). The control system includes an angle sensor group (8) that detects rotational angles of the boom (1*a*), the arm (1*b*), and the bucket (1*c*), and a tilting angle sensor group (81) that detects ground angles of the boom (1*a*), the arm (1*b*), and the bucket (1*c*). The control unit (9) selects, from among the angle sensor group (8) and the tilting angle sensor group (81), a sensor to be used for calculating a posture and a position of each of the boom (1*a*), the arm (1*b*), and the bucket (1*c*) in accordance with a magnitude of speed of at least one of the boom (1*a*), the arm (1*b*), and the bucket (1*c*).

5 Claims, 17 Drawing Sheets

(51) Int. Cl.

| | |
|---|---|
| ***G06G 7/00*** | (2006.01) |
| ***G06G 7/76*** | (2006.01) |
| ***E02F 3/43*** | (2006.01) |
| ***E02F 9/22*** | (2006.01) |
| ***E02F 9/26*** | (2006.01) |
| ***E02F 3/32*** | (2006.01) |
| ***E02F 3/42*** | (2006.01) |
| ***E02F 9/20*** | (2006.01) |

(52) U.S. Cl.
CPC ..... *E02F 9/2225* (2013.01); *E02F 9/2285* (2013.01); *E02F 9/265* (2013.01)

(58) Field of Classification Search
USPC ..... 701/50
See application file for complete search history.

(56) References Cited

FOREIGN PATENT DOCUMENTS

| | | | |
|---|---|---|---|
| JP | 9-302708 | A | 11/1997 |
| JP | 3056254 | B2 | 6/2000 |

OTHER PUBLICATIONS

Japanese-language Written Opinion (PCT/ISA/237) issued in PCT Application No. PCT/JP2014/080104 dated Feb. 17, 2015 (4 pages).
International Preliminary Report on Patentability (PCT/IB/338 & PCT/IB/373) issued in PCT Application No. PCT/JP2014/080104 dated Oct. 13, 2016, including English translation of document C2 (Japanese-language Written Opinion (PCT/ISA/237)) previously filed on Mar. 28, 2016 (seven pages).

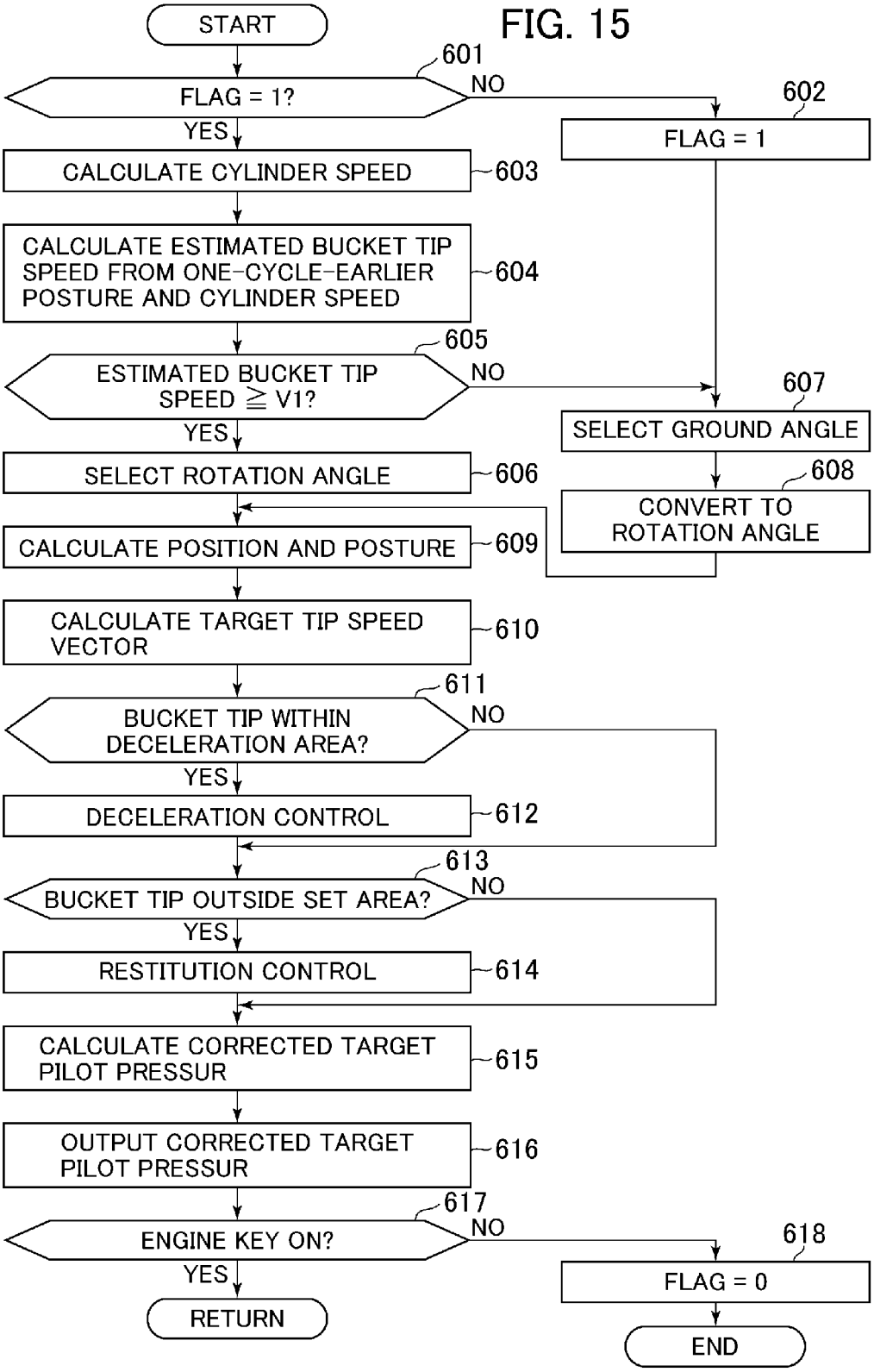
FIG. 15
START
601
FLAG = 1?
NO
YES
602
FLAG = 1
CALCULATE CYLINDER SPEED
603
CALCULATE ESTIMATED BUCKET TIP SPEED FROM ONE-CYCLE-EARLIER POSTURE AND CYLINDER SPEED
604
605
ESTIMATED BUCKET TIP SPEED ≧ V1?
NO
607
SELECT GROUND ANGLE
YES
SELECT ROTATION ANGLE
606
608
CONVERT TO ROTATION ANGLE
CALCULATE POSITION AND POSTURE
609
CALCULATE TARGET TIP SPEED VECTOR
610
611
BUCKET TIP WITHIN DECELERATION AREA?
NO
YES
DECELERATION CONTROL
612
613
BUCKET TIP OUTSIDE SET AREA?
NO
YES
RESTITUTION CONTROL
614
CALCULATE CORRECTED TARGET PILOT PRESSUR
615
OUTPUT CORRECTED TARGET PILOT PRESSUR
616
617
ENGINE KEY ON?
NO
618
YES
FLAG = 0
RETURN
END

AREA LIMITING EXCAVATION CONTROL SYSTEM FOR CONSTRUCTION MACHINES

TECHNICAL FIELD

The present invention relates to a control system for limiting an area where a work implement assembly of a construction machine can move during excavating.

BACKGROUND ART

A typical example of construction machines is a hydraulic excavator. A hydraulic excavator includes a work implement assembly (front work implement assembly), a swing structure to which a boom base end of the work implement assembly is mounted, and a track structure provided below the swing structure. The work implement assembly includes a boom, an arm, and a bucket (a plurality of driven members), each able to rotate about an approximately horizontal rotating shaft, that are connected together. In a hydraulic excavator, the driven members such as the boom are each operated with a control lever (operating unit) that controls a driving direction and driving speed. When the control lever is operated, the driven member makes a rotating motion about a rotating shaft. As a result, when one of the driven members is operated with the control lever, for example, a tip of the bucket basically traces a circular path. In order to form a planar excavation surface with the hydraulic excavator, for example, by leveling the bucket, therefore, operation of the control lever is complicated, requiring considerable skills and experience.

For this reason, a device that facilitates such a task (area limiting excavation control system) is disclosed in JP-3056254 B. The present document discloses an area limiting excavation control system for hydraulic excavators, configured as follows. The work area limiting excavation control system accepts, in advance, a setting as to an area within which a front work implement assembly can move. The control system calculates, with a control unit, a position and a posture of the front work implement assembly based on a signal supplied from an angle sensor and calculates a target speed vector of the work implement assembly based on a signal supplied from an operating unit. The control system maintains the target speed vector unchanged when the front work implement assembly is within the set area but not close to a boundary thereof. The control system corrects the target speed vector such that a vector component in the direction of approaching the boundary of the set area is reduced when the front work implement assembly is within the set area and close to the boundary thereof. The control system corrects the target speed vector such that the front work implement assembly goes back into the set area when the front work implement assembly is outside the boundary of the set area. This allows excavation to be conducted within a limited area in a highly efficient and smooth manner. As a result, the area set in advance serves as a basic movable range of the bucket, thus facilitating excavation along the boundary of the area irrespective of operator's degree of skill.

PRIOR ART DOCUMENT

Patent Document

Patent Document 1: JP-3056254 B

SUMMARY OF THE INVENTION

Problem to be Solved by the Invention

Incidentally, the sensors used in the above document to calculate a tip position of the bucket and the posture of the front work implement assembly are angle sensors (i.e., rotary potentiometers) or displacement sensors (i.e., linear potentiometers). The angle sensors are embedded in the rotating shafts of the driven members such as the boom to detect rotation angles (relative angles) of the driven members about the rotating shafts. The displacement sensors detect strokes (displacements) of hydraulic cylinders that drive the driven members.

Certainly, these potentiometers offer excellent responsiveness, making them suited for position and posture calculations for the front work implement assembly during quick motion and motion speed calculations for the front work implement assembly. However, since potentiometers are designed to output relative angles of components such as the boom, arm, and bucket, if the tip position of the bucket and the posture of the front work implement assembly are calculated based on the above outputs, errors are likely to be accumulated. Therefore, it is difficult to say that potentiometers are optimal sensors for position and posture detection, for example, during fine operation, a case where excellent responsiveness, i.e., an advantage of potentiometers, is unlikely to serve as a benefit. That is, the technique described in the above document leaves room for improvement if the importance of potentiometer responsiveness is relatively low.

It is an object of the present invention to provide an area limiting excavation control system for construction machines that provides improved excavation accuracy if a driven member moves at relatively low speed.

Means for Solving the Problem

In order to achieve the above object, an area limiting excavation control system for construction machines according to the present invention includes a multi-joint work implement assembly, a plurality of hydraulic actuators, a plurality of operating units, a plurality of flow control valves, and a control unit. The multi-joint work implement assembly includes a plurality of driven members, each able to rotate about a rotating shaft provided on a joint, that are connected together. Each of the hydraulic actuators drives one of the plurality of driven members to rotate about the rotating shaft. Each of the operating units gives a motion instruction to one of the plurality of hydraulic actuators in accordance with an operation amount of the operating unit. Each of the flow control valves is driven in accordance with an operation signal output in accordance with the operation amount of one of the plurality of operating units to control a flow rate and a direction of flow of a hydraulic fluid supplied to one of the plurality of hydraulic actuators. The control unit performs area limiting control that controls at least one of a driving direction and a driving speed of at least one of the plurality of hydraulic actuators on the basis of the operation amount of each of the plurality of operating units and of a posture and a position of each of the driven members such that the closer a distance to the tip portion from a boundary of a set area within which a tip portion of the work implement assembly can move to zero, the closer a speed vector perpendicular component of the tip portion relative to the boundary to zero. The area limiting excavation control system further includes first and second sensor groups. The first sensor group detects rotation angles of the plurality of driven members relative to the rotating shaft. The second sensor group detects tilting angles of the plurality of driven members relative to a reference plane. During the area limiting control, the control unit selects, from among the first and second sensor groups, sensors to be used for calculating a posture and a position of each of the plurality of driven members in accordance with a magnitude of speed of at least one of the plurality of driven members.

Effect of the Invention

The present invention permits highly accurate detection of a position and a posture of a work implement assembly when the work implement assembly moves at relatively low speed while at the same time ensuring excellent responsiveness obtained in a case where the work implement assembly moves at relatively high speed, thus contributing to improved accuracy in area limiting excavation control.

BRIEF DESCRIPTION OF THE DRAWINGS

FIG. 15 is a flowchart of processing performed by the area limiting excavation control system for construction machines according to the third embodiment of the present invention;

MODES FOR CARRYING OUT THE INVENTION

Figure 1:
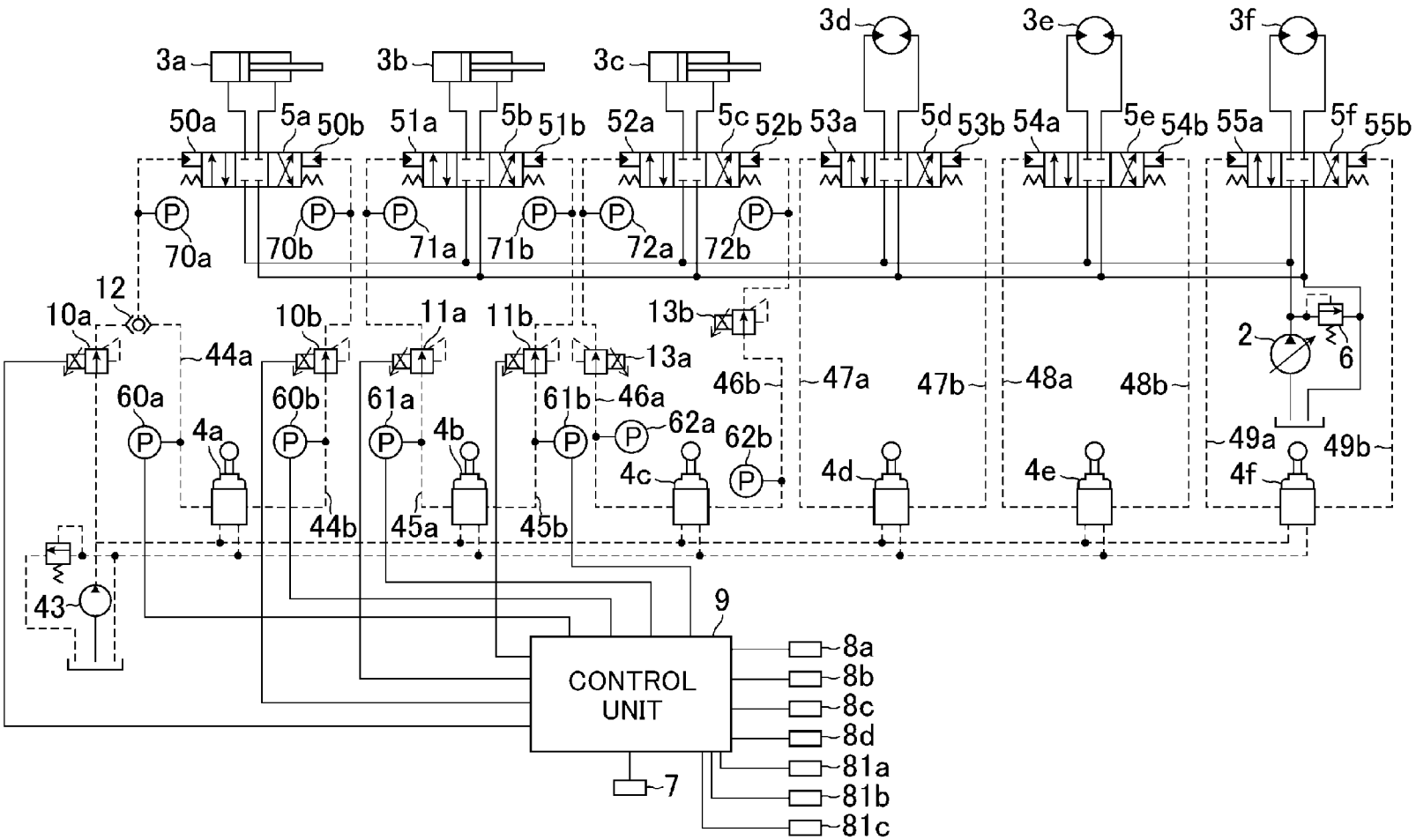
FIG. 1 is a diagram illustrating an area limiting excavation control system for construction machines according to an embodiment of the present invention together with a hydraulic drive system.

A description will be given first of main features of an area limiting excavation control system for construction machines according to embodiments of the present invention described below.

(1) An area limiting excavation control system for construction machines according to the present embodiment includes a multi-joint work implement assembly, a plurality of hydraulic actuators, a plurality of operating units, a plurality of flow control valves, and a control unit. The multi-joint work implement assembly is configured by connecting a plurality of driven members that can each rotate about a rotating shaft provided on a joint. Each of the hydraulic actuators drives one of the plurality of driven members to rotate about the rotating shaft. Each of the operating units gives a motion instruction to one of the plurality of hydraulic actuators in accordance with an operation amount thereof. Each of the flow control valves is driven in accordance with an operation signal output in accordance with the operation amount of one of the plurality of operating units to control a flow rate and a flow direction of a hydraulic fluid supplied to one of the plurality of hydraulic actuators. The control unit executes an area limiting control that controls at least one of a driving direction and a driving speed of at least one of the plurality of hydraulic actuators based on the operation amount of each of the plurality of operating units and a posture and a position of each of the driven members such that the closer a distance from a boundary of a set area within which a tip portion of the work implement assembly can move, to the tip portion to zero, the closer a speed vector component of the tip portion perpendicular to the boundary to zero. The area limiting excavation control system further includes first and second sensor groups. The first sensor group consists of a plurality of sensors that detect rotation angles of the plurality of driven members relative to the respective rotating shafts, respectively. The second sensor group consists of a plurality of sensors that detect tilting angles of the plurality of driven members relative to a reference plane, respectively. During execution of the area limiting control, the control system selects, from among the first and second sensor groups, a sensor to be used for calculating a posture and a position of each of the plurality of driven members, in accordance with a magnitude of speed of at least one of the plurality of driven members.

In feature (1) described above, specific examples of sensors included in the first sensor group are rotary potentiometers and stroke potentiometers. Sensors of this kind offer excellent responsiveness and have the advantage that even if the work implement assembly moves relatively fast, the sensors can track the motion of the work implement assembly and detect postures and positions of the respective driven members. On the other hand, however, since sensors of this kind are designed to detect relative angles or relative displacements of the driven members, calculation of the posture of the work implement assembly or the position of the tip portion based on a detection signal thereof makes it highly likely that error will accumulate.

Further, specific examples of sensors included in the second sensor group are tilting angle sensors (e.g., liquid-sealed capacitive tilting angle sensors) that detect tilting angles of attached driven members relative to a certain reference plane ("ground angle" that has a horizontal plane (ground plane) set as a reference plane is often used as a tilting angle). Sensors of this kind offer higher accuracy than the potentiometers described above and have the advantage such that they can calculate, with high accuracy, the posture of the work implement assembly and the position of the tip portion thereof. On the other hand, however, sensors of this kind offer poorer responsiveness and have the disadvantageous such that if the work implement assembly moves relatively fast, they cannot track the motion of the work implement assembly, thus providing an upper limit of the available motion speed.

For this reason, during area limiting control, the area limiting excavation control system according to the embodiments of the present invention selects sensors to be used for calculating a posture and a position of each of the plurality of driven members from among the first and second sensor groups, in accordance with the magnitude of speed of at least one of the plurality of driven members. This makes it possible to select sensors to be used in accordance with the speed of the driven member. Therefore, for example, a minimum speed at which the first sensor group can respond is used as a setting value, when the magnitude of speed of at least one of the plurality of driven members is equal to or larger than the setting value, the first sensor group is used to calculate a posture and a position of the at least one driven member, and when the magnitude of speed of the at least one driven member is smaller than the setting value, the second sensor group is used to calculate a posture and a position of the at least one driven member. This permits highly accurate detection of a position and a posture of the work implement assembly when the work implement assembly moves at relatively low speed while ensuring excellent responsiveness obtained in a case where the work implement assembly moves at relatively high speed, thus contributing to improved accuracy in area limiting excavation control.

(2) In feature (1), during execution of the area limiting control, the control unit should preferably calculate a posture and a position of each of the plurality of driven members based on a detection signal of the first sensor group when the magnitude of speed of the tip portion of the work implement assembly is equal to or larger than a setting value, and the control unit should preferably calculate a posture and a position of each of the plurality of driven members based on a detection signal of the second sensor group when the magnitude of speed of the tip portion of the work implement assembly is smaller than the setting value.

If a posture and a position are calculated in this manner, the detection signal of the first sensor group is used when excellent responsiveness is required owing to a fast motion of the tip portion of the work implement assembly (when the magnitude of speed is equal to or higher than the setting value). On the other hand, if the detection signal of the third sensor group is used when high accuracy is required owing to a slow motion of the tip portion of the work implement assembly (when the magnitude of speed is smaller than the setting value). This makes it possible to calculate the posture of the work implement assembly and the position of the tip portion using the detection signal of the sensor group appropriate to the motion speed. As a result, it is possible to detect a position and a posture of the work implement assembly with high accuracy when the work implement assembly moves at relatively low speed while ensuring excellent responsiveness obtained in a case where the work implement assembly moves at relatively high speed, thus contributing to improved accuracy in area limiting excavation control. For example, slow motion of the work implement assembly when putting finishing touches on an excavation surface makes it easy to finish the excavation surface flat quickly irrespective of operator's degree of skill.

It should be noted that the setting value should preferably be a speed at which both the first and second sensor groups can respond. The setting value should more preferably be a minimum speed at which the first sensor group can respond or a speed close thereto and at the same time a maximum speed at which the second sensor group can respond or a speed close thereto. If the first and second sensor groups that meet such conditions are mounted, and if, at the same time, the setting value is specified as described above, it is possible to eliminate a motion speed that cannot be covered by both of the first and second sensor groups.

(3) In feature (1) or (2), during execution of the area limiting control, the control unit should preferably use the detection signal of the first sensor group to calculate a posture and a position of one of the plurality of driven members, a magnitude of speed of the one of the plurality of driven members being equal to or larger than the setting value, and the control unit should preferably use the detection signal of the second sensor group to calculate a posture and a position of one of the plurality of driven members, a magnitude of speed of the one of the plurality of driven members being smaller than the setting value.

In feature (2), sensors to be used are selected in accordance with a target speed of the tip of the work implement assembly. In contrast, sensors to be used are selected in accordance with the speed of each of the driven members in feature (3). As a result, sensors to be used are selected in accordance with an actual motion speed of each of the driven members. This makes it possible to calculate a posture of the work implement assembly and the position of the tip portion thereof based on a detection signal of a sensor more adequate for the motion speed of each of the driven members than in feature (2), thus providing higher potential for work improvement in area limiting excavation control accuracy.

(4) Further, in any of features (1) to (3), the plurality of driven members should preferably be connected in series relative to the construction machine main body as a base point. During execution of the area limiting control, the control unit should preferably use the detection signal of the first sensor group to calculate a posture and a position of a fast motion member of the plurality of driven members, a magnitude of speed of the fast motion member being equal to or higher than the setting value, and to calculate postures and positions of other all of the plurality of driven members connected farther away, in terms of a link, from the construction machine main body than the fast motion member. The control unit should preferably use the detection signal of the second sensor group to calculate postures and positions of the remaining ones of the plurality of driven members.

Thus, the plurality of driven members are connected in series from the side of the construction machine main body as one end to other end. If, halfway through the connection of the driven members, a driven member whose target speed is equal to or higher than the setting value (referred to as a "fast motion member" here) is present, the motion speeds of other driven members located far, in terms of a link, from the machine main body relative to the fast motion member increase. Therefore, even if relative speeds of the other driven members relative to the fast motion member are lower than the setting value, and even if sensors of the second sensor group should be used based on a philosophy described in feature (3), since the speeds of the other driven members relative to ground may exceed the setting value, using sensors of the second sensor group that have poorer responsiveness may result in degraded accuracy due to faulty detection. However, if there is a fast motion member in the serial link, but when the control unit is configured as described in feature (4), sensors of the first sensor group are used to calculate postures and positions of all the driven members located on a side separating from the fast motion member in the link, thus avoiding faulty detection and preventing degraded accuracy.

It should be noted that if feature (4) is applied to a typical hydraulic excavator, when the speed of the boom is larger than the setting value, angles of a boom, an arm, and a bucket, are all calculated based on detection signals of the first sensor group irrespective of speeds of the arm and the bucket (attachments). Similarly, if the speed of the boom is lower than the setting value, when the speed of the arm is equal to or larger than the setting value, the angles of the arm and the bucket are calculated by the first sensor group, and the angle of the boom is calculated by the second sensor group.

(5) Further, an area limiting excavation control system for construction machines according to the present embodiment includes a multi-joint work implement assembly, a plurality of hydraulic actuators, a plurality of operating units, a plurality of flow control valves, first and second sensor groups, high-pass and low-pass filter sections, and a control unit. The multi-joint work implement assembly configured by connecting a plurality of driven members that can each rotate about a rotating shaft provided on a joint. Each of the hydraulic actuators drives one of the plurality of driven members to rotate about the rotating shaft. Each of the operating units gives a motion instruction to one of the plurality of hydraulic actuators in accordance with an operation amount thereof. Each of the flow control valves is driven in response to an operation signal output in accordance with the operation amount of one of the plurality of operating units to control a flow rate and a flow direction of a hydraulic fluid supplied to one of the plurality of hydraulic actuators. The first sensor group consists of a plurality of sensors that detect rotation angles of the plurality of driven members relative to the rotating shaft, respectively. The second sensor group consists of a plurality of sensors that detect tilting angles of the plurality of driven members relative to a reference plane, respectively. The high-pass filter section extracts a frequency higher than a set frequency from each of detection signals of the first sensor group. The low-pass filter section extracts a frequency lower than the set frequency from each of detection signals of the second sensor group. The control unit executes an area limiting control that controls at least one of a driving direction and a driving speed of at least one of the plurality of hydraulic actuators based on a posture and a position of one of the driven members calculated from a combined signal of two signals, one that has passed through the high-pass filter section and another through the low-pass filter section, and the operation amount of one of the plurality of operating units such that the closer a distance from a boundary of a set area within which a tip portion of the work implement assembly can move to the tip portion to zero, the closer a speed vector component of the tip portion perpendicular to the boundary to zero.

In the area limiting excavation control system configured as described in feature (5), a signal passing through the high-pass filter section (signal containing many high frequency components) is detected by the first sensor group when the driven member moves at relatively high speed. On the other hand, a signal passing through the low-pass filter section (signal containing many low frequency components) is detected by the second sensor group when the driven member moves at relatively low speed or comes to a halt. Therefore, by using a combined signal of two signals, one that has passed through the high-pass filter section and another through the low-pass filter section, as described above for posture and position calculation, two detection signals are available for use, one from the first sensor group that offers excellent responsiveness during fast motion of the driven member and another from the second sensor group that offers high accuracy during slow motion, motion at constant speed, or halt of the driven member. This provides improved accuracy in area limiting excavation control when the motion speed of the work implement assembly is relatively low while ensuring excellent responsiveness obtained in a case where the work implement assembly moves at relatively high speed, as does the configurations described in features (1) to (4).

A description will be given below of embodiments when the present invention is applied to a hydraulic excavator with reference to the accompanying drawings. It should be noted that although a hydraulic excavator having a bucket (1*c*) as an attachment at the tip of a work implement assembly is illustrated in the description given below, the present invention may be applied to a hydraulic excavator having an attachment other than a bucket. Further, in the description given below, an alphabet may be added at the end of a reference numeral (number) if a plurality of components of the same kind are provided, and these components may be collectively denoted without the alphabet. For example, if there are three pumps 1000*a*, 1000*b*, and 1000*c* of the same kind, these pumps may be collectively denoted as the pumps 1000.

FIG. 1 is a diagram illustrating an area limiting excavation control system for construction machines according to an embodiment of the present invention together with a hydraulic drive system. The hydraulic excavator illustrated in FIG. 1 includes a hydraulic pump 2, a plurality of hydraulic actuators, a plurality of operating units 4*a* to 4*f*, a plurality of flow control valves 5*a* to 5*f*, and a relief valve 6. The hydraulic actuators include a boom cylinder 3*a*, an arm cylinder 3*b*, a bucket cylinder 3*c*, a swing motor 3*d*, and left and right traveling motors 3*e* and 3*f* that are driven by hydraulic fluid supplied from the hydraulic pump 2. The operating units 4*a* to 4*f* are provided, each associated with one of the hydraulic actuators 3*a* to 3*f*. The flow control valves 5*a* to 5*f* are connected, each between the hydraulic pump 2 and one of the hydraulic actuators 3*a* to 3*f*, and each controlled by an operation signal of one of the operating units 4*a* to 4*f*, to control a flow rate of hydraulic fluid supplied to one of the hydraulic actuators 3*a* to 3*f*. The relief valve 6 opens when a pressure applied between the hydraulic pump 2 and one of the flow control valves 5*a* to 5*f* is equal to or higher than a setting value. These components make up a hydraulic drive system that drives driven members of the hydraulic excavator.

Figure 2:
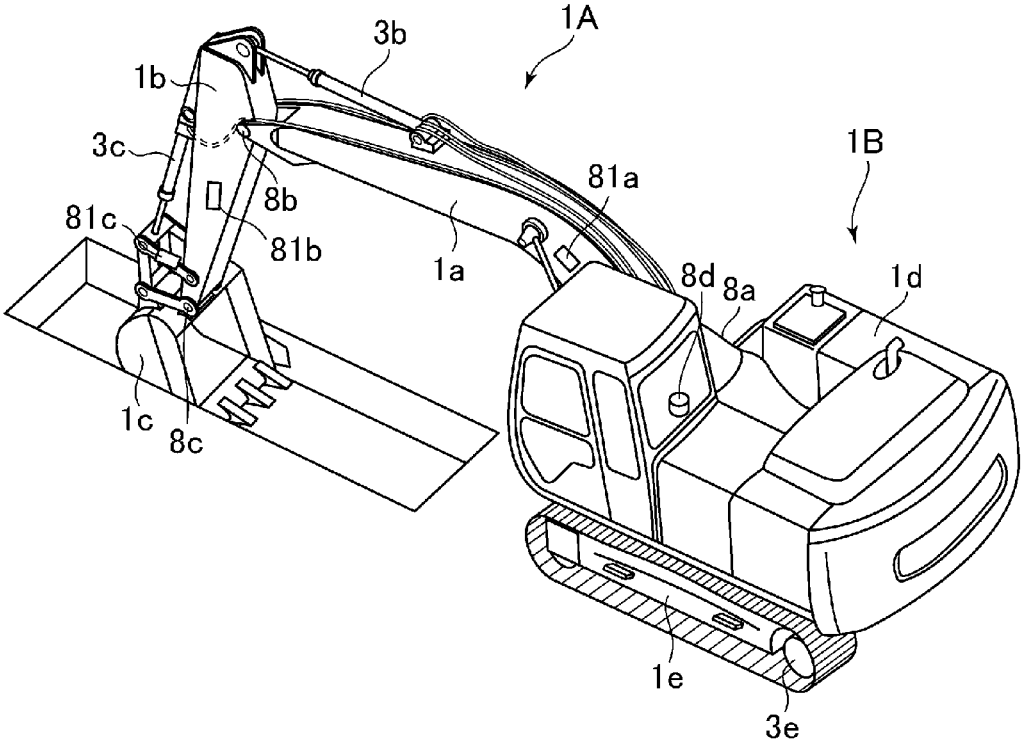
FIG. 2 is a diagram illustrating an appearance of a hydraulic excavator to which the present invention is applied and a shape of a set area around the hydraulic excavator.

FIG. 2 is a diagram illustrating an appearance of the hydraulic excavator to which the present invention is applied and a shape of a set area around the hydraulic excavator. As illustrated in FIG. 2, the hydraulic excavator includes a multi-joint work implement assembly 1A (front work implement assembly) and a construction machine main body 1B. The multi-joint work implement assembly (front work implement assembly) 1A includes a boom 1*a*, an arm 1*b*, and a bucket 1*c*, each rotating up and down (vertically) about an approximately horizontal rotating shaft. The construction machine main body 1B includes an upper swing structure 1*d* and a lower track structure 1*e*. A base end of the boom 1*a* of the work implement assembly 1A is supported by a front portion of the upper swing structure 1*d*. The boom 1*a*, the arm 1*b*, the bucket 1*c*, the upper swing structure 1*d*, and the lower track structure 1*e* make up driven members that are driven by the boom cylinder 3*a*, the arm cylinder 3*b*, and the bucket cylinder 3*c*, the swing motor 3*d*, and the left and right traveling motors 3*e* and 3*f*, respectively. Motions of the above driven members are directed by the operating units 4*a* to 4*f*.

Figure 3:
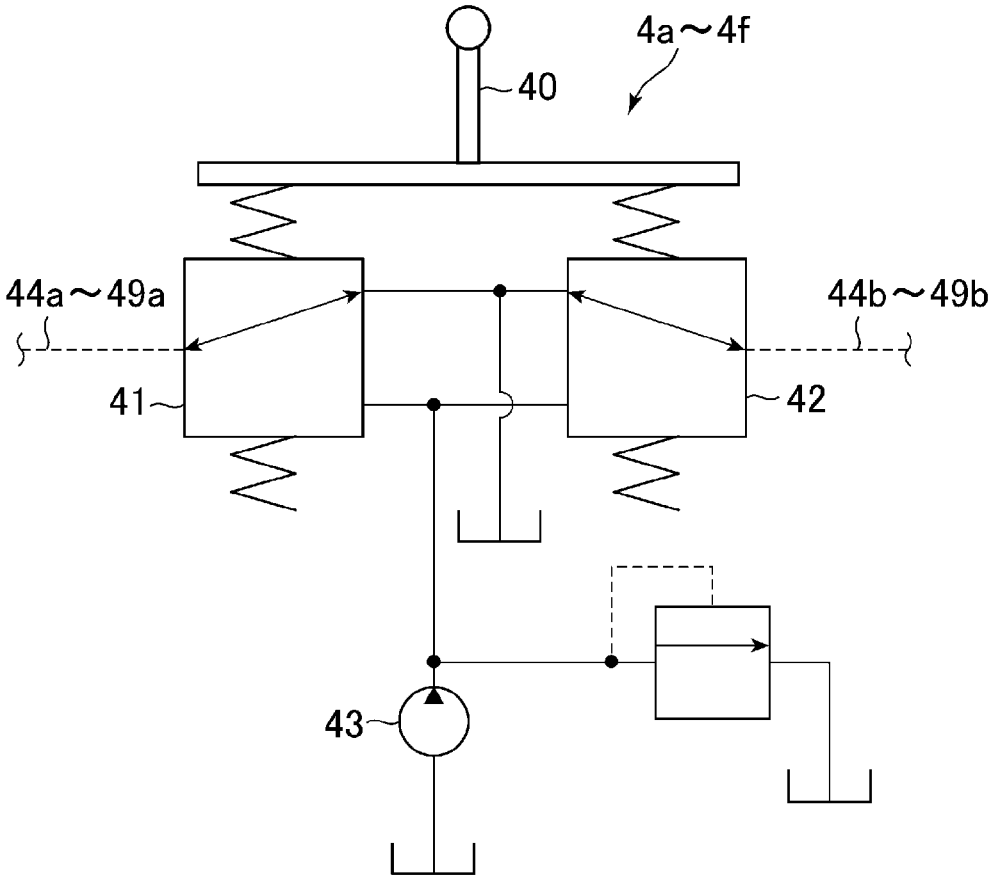
FIG. 3 is a diagram illustrating details of hydraulic pilot operating units.

FIG. 3 is a diagram illustrating details of hydraulic pilot operating units 4*a* to 4*f*. The operating units 4*a* to 4*f* are hydraulic pilot operating units that each drive the associated flow control valves 5*a* to 5*f* by a pilot pressure. Each of the operating units 4*a* to 4*f* includes a control lever 40 and a pair of pressure reducing valves 41 and 42 as illustrated in FIG. 3. The control lever 40 is operated by an operator. The pressure reducing valves 41 and 42 each produce a pilot pressure appropriate to an operation amount and direction of operation of the control lever 40. Primary ports of the pressure reducing valves 41 and 42 are connected to the pilot pump 43, and secondary ports thereof are connected to hydraulic control sections 50*a* and 50*b*, 51*a* and 51*b*, 52*a* and 52*b*, 53*a* and 53*b*, 54*a* and 54*b*, or 55*a* and 55*b* of the associated flow control valve via pilot lines 44*a* and 44*b*, 45*a* and 45*b*, 46*a* and 46*b*, 47*a* and 47*b*, 48*a* and 48*b*, or 49*a* and 49*b*.

An area limiting excavation control system according to the present embodiment is provided in the hydraulic excavator constructed as described above. This control system includes a setting device 7 (refer to FIG. 1), angle sensors (rotary potentiometers) 8*a* to 8*c*, a tilting angle sensor 8*d*, tilting angle sensors (e.g., liquid-sealed capacitive tilting angle sensors) 81*a* to 81*c*, pressure sensors 60*a*, 60*b*, 61*a*, 61*b*, 62*a*, and 62*b*, a control unit (control device) 9, proportional solenoid valves 10*a*, 10*b*, 11*a*, 11*b*, 13*a*, and 13*b*, pressure sensors 70*a*, 70*b*, 71*a*, 71*b*, 72*a*, and 72*b*, and a shuttle valve 12. The setting device 7 specifies, in advance, a boundary of a set area within which a predetermined portion of the work implement assembly such as the tip of the bucket 1*c* can move in accordance with a type of work to be undertaken. The angle sensors 8*a* to 8*c* are provided respectively on pins of the boom 1*a*, the arm 1*b*, and the bucket 1*c* which pins serve as rotation fulcrums and a connecting member, to detect relative rotation angles thereof as state quantities relating to a position and a posture of the work implement assembly 1A. The tilting angle sensor 8*d* detects a tilting angle θ of the construction machine main body 1B mounted to the upper swing structure 1*d* relative to a reference plane (e.g., horizontal plane). The tilting angle sensors 81 to 81*c* are attached to the boom 1*a*, the arm 1*b*, and the bucket 1*c*, respectively, to detect tilting angles (ground angles) relative to a horizontal plane. The pressure sensors 60*a*, 60*b* are provided in the pilot lines 44*a* and 44*b*, 45*a* and 45*b*, and 46*a* and 46*b* for the operating units 4*a* to 4*c* that are used respectively for the boom 1*a*, the arm 1*b*, and the bucket 1*c*, to detect the pilot pressures of the operating units 4*a* to 4*c* as operation amounts. The control unit 9 receives a setting signal of the setting device 7, detection signals of the angle sensors 8*a* to 8*c* or a detection signal of the tilting angle sensor 8*d*, and detection signals of the pressure sensors 60*a*, 60*b*, 61*a*, 61*b*, 62*a*, 62*b*, 70*a*, 70*b*, 71*a*, 71*b*, 72*a*, and 72*b* to specify a set area within which the tip of the bucket 1*c* can move and output an electric signal for area limiting excavation control. The proportional solenoid valves 10*a*, 10*b*, 11*a*, 11*b*, 13*a*, and 13*b* are driven by the electric signal. The pressure sensors 70*a*, 70*b*, 71*a*, 71*b*, 72*a*, and 72*b* detect pilot pressures that pass through the proportional solenoid valves 10*a*, 10*b*, 11*a*, 11*b*, 13*a*, and 13*b* to eventually act on the flow control valves 5*a* to 5*f*.

In the description given above, the pressure sensors 60*a*, 60*b*, 61*a*, 61*b*, 62*a*, and 62*b* make up a sensor group that detects pilot pressures as state quantities relating to the operation amounts of the plurality of operating units 4*a* to 4*c* (operation amounts of levers). The operating units 4*a* to 4*c* are used to drive the boom 1*a*, the arm 1*b*, and the bucket 1*c*. It should be noted that pilot pressures are merely examples, and that the operation amounts of the control levers of the operating units 4*a* to 4*c* may be detected by position sensors (e.g., rotary encoders) that detect rotational displacements of the control levers.

Further, the angle sensors 8*a* to 8*c* make up a sensor group (first sensor group) that detects state quantities relating to the rotation angles of the boom 1*a*, the arm 1*b*, and the bucket 1*c*, respectively, relative to the rotating shafts (pins). It should be noted that displacements of the boom cylinder 3*a*, the arm cylinder 3*b*, and the bucket cylinder 3*c* may be detected with displacement sensors (e.g., linear potentiometers), followed by conversion of the displacements into the rotation angles of the boom 1*a*, the arm 1*b*, and the bucket 1*c* rather than directly detecting the rotation angles with the angle sensors 8.

Then, the tilting angle sensors 81*a* to 81*c* make up a sensor group (second sensor group) that detects state quantities relating to the tilting angles (ground angles) of the boom 1*a*, the arm 1*b*, and the bucket 1*c* relative to a horizontal plane, respectively. It should be noted that although an example is described here where the tilting angles relative to a horizontal plane are detected with the tilting angle sensors 81*a* to 81*c*, it is only necessary to detect tilting angles relative to a certain plane (reference plane), if not relative to a horizontal plane.

Referring back to FIG. 1, the primary port of the proportional solenoid valve 10*a* is connected to the pilot pump 43, and the secondary port thereof to the shuttle valve 12. The shuttle valve 12 is provided in the pilot line 44*a* to select the higher of two pressures, the pilot pressure in the pilot line 44*a* and a control pressure output from the proportional solenoid valve 10*a*, and guide the selected pressure to the hydraulic control section 50*a* of the flow control valve 5*a*. The proportional solenoid valves 10*b*, 11*a*, 11*b*, 13*a*, and 13*b* are provided respectively in the pilot lines 44*b*, 45*a*, 45*b*, 46*a*, and 46*b* to reduce the pilot pressures in the pilot lines and output reduced pressures in accordance with electric signals supplied, respectively, to these valves.

It should be noted that although FIG. 1 illustrates the proportional solenoid valves 13*a* and 13*b*, the pressure sensors 62*a* and 62*b*, the pressure sensors 70*a*, 70*b*, 71*a*, 71*b*, 72*a*, and 72*b*, and the control unit 9 as if these components are not connected and therefore cannot communicate with each other through a communication line for reasons of space, we assume that they can receive electric signals as can the other proportional solenoid valves 10 and 11.

The setting device 7 outputs a setting signal to the control unit 9 using an operating means such as a control panel or a switch provided on a grip of one of the operating units 4 in the cabin of the upper swing structure 1*d* to instruct that a boundary of a set area be specified. Other auxiliary means such as display device may be provided on the control panel. Alternatively, an IC card, barcode, laser, wireless communication or other approach may be used instead.

Figure 4:
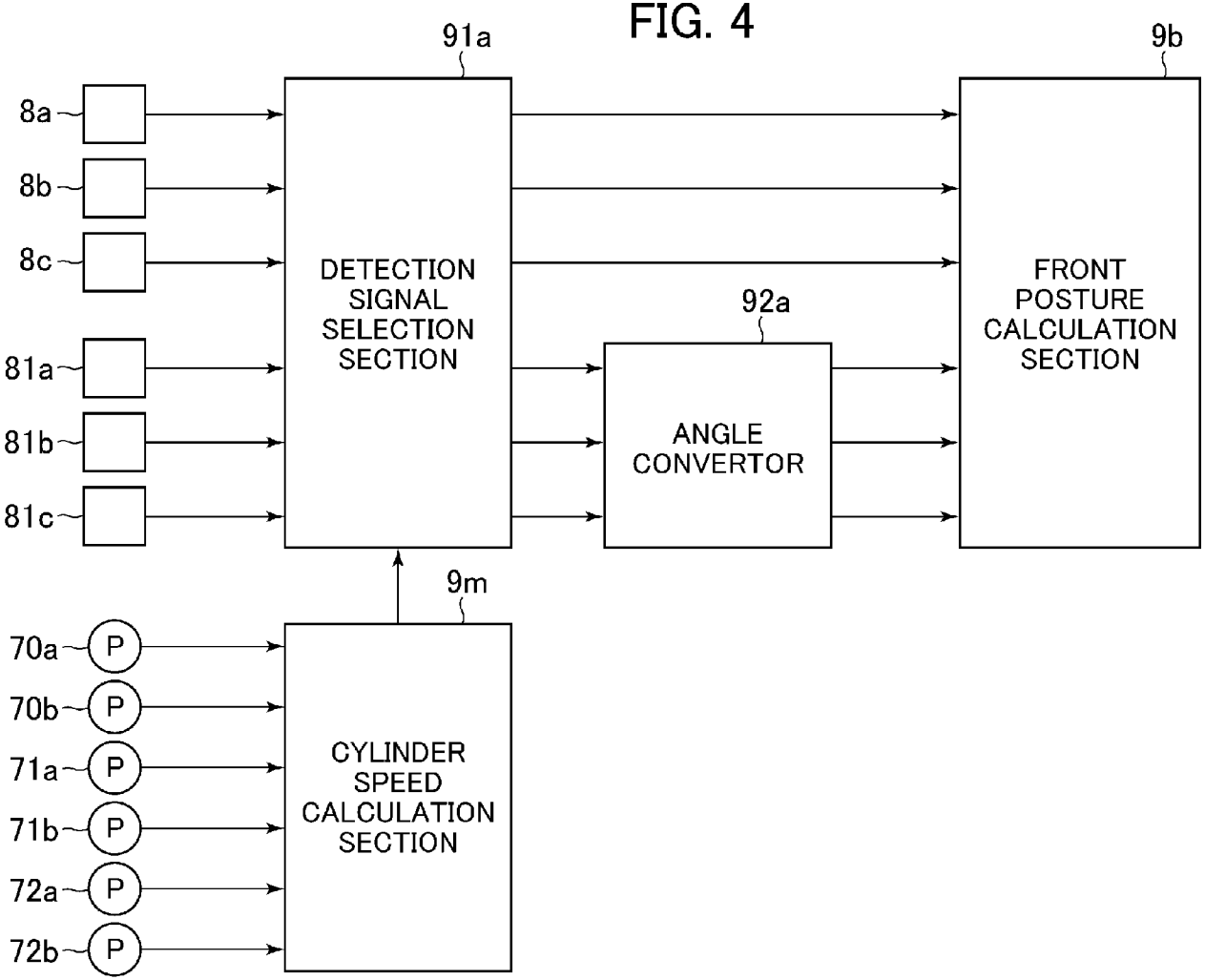
FIG. 4 is a functional block diagram illustrating some of control functions of a control unit.
Figure 5:
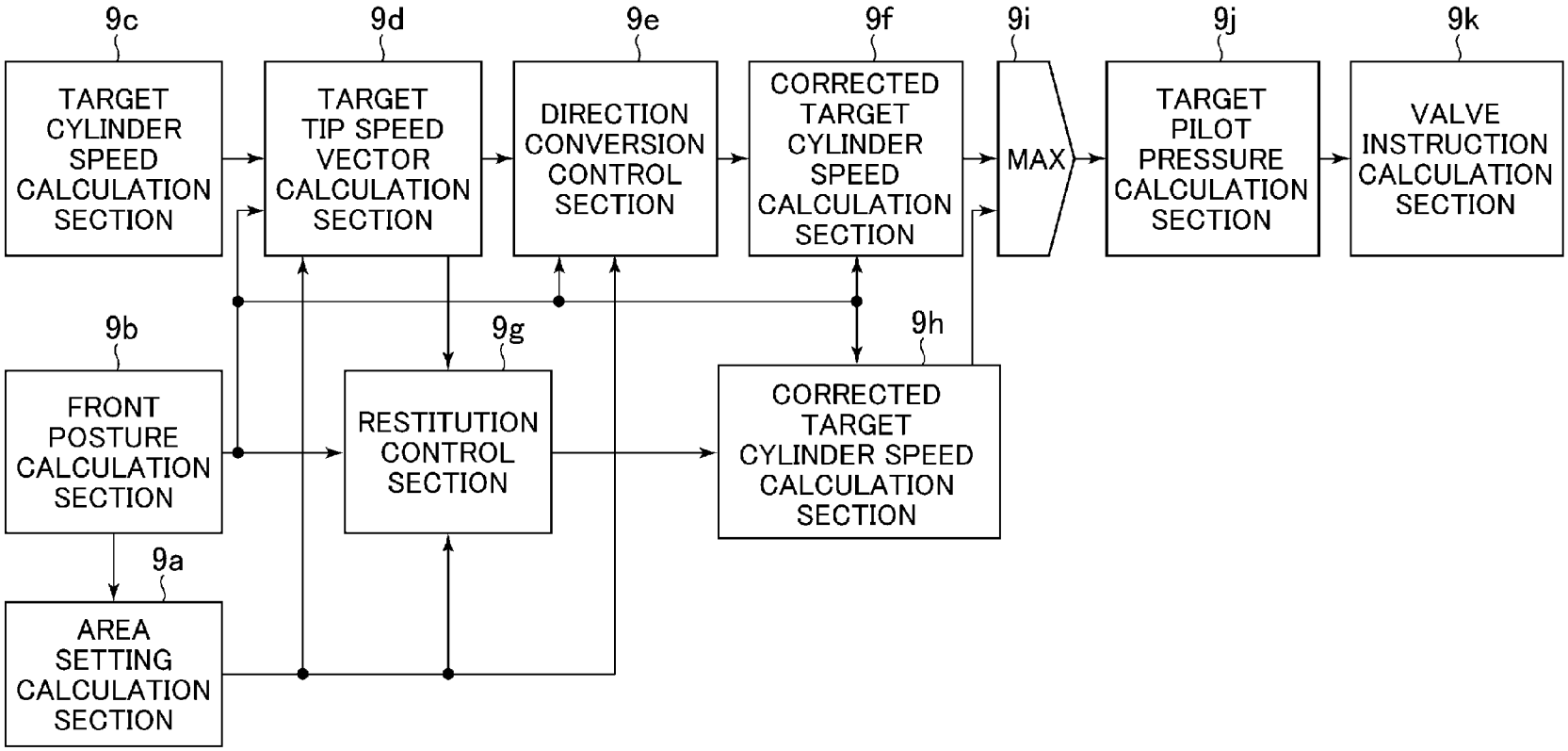
FIG. 5 is a functional block diagram illustrating some of control functions of a control unit.

Control functions of the control unit 9 according to a first embodiment of the present invention are illustrated in FIGS. 4 and 5. As illustrated in these figures, the control unit 9 includes, as its functions, a cylinder speed calculation section 9*m*, a detection signal selection section 91*a*, an angle convertor 92*a*, a front posture calculation section 9*b*, an area setting calculation section 9*a*, a target cylinder speed calculation section 9*c*, a target tip speed vector calculation section 9*d*, a direction conversion control section 9*e*, a corrected target cylinder speed calculation section 9*f*, a restitution control section 9*g*, a corrected target cylinder speed calculation section 9*h*, a target cylinder speed selection section 9*i*, a target pilot pressure calculation section 9*j*, and a valve instruction calculation section 9*k*.

It should be noted that although not illustrated, we assume that the control unit 9 includes an arithmetic processing unit (e.g., CPU) as a calculation means, a storage device (e.g., ROM, RAM, flash memory and other semiconductor memories and magnetic storage device such as hard disk drive) as a storage means, and input/output arithmetic processing devices. The arithmetic processing unit executes various programs to deliver the functions illustrated in FIGS. 4 and 5. The storage device stores the programs and various data. The input/output arithmetic processing device controls input and output of data, instructions, and other information to and from the arithmetic processing unit and the storage device.

In FIG. 4, the cylinder speed calculation section 9*m* receives pilot pressures values detected by the pressure sensors 70*a*, 70*b*, 71*a*, 71*b*, 72*a*, and 72*b* to find delivery rates of the flow control valves 5*a* to 5*c* and further calculate current speeds of the boom cylinder 3*a*, the arm cylinder 3*b*, and the bucket cylinder 3*c*. The storage device of the control unit 9 stores relationships between pilot pressures detected by the pressure sensors 70*a*, 70*b*, 71*a*, 71*b*, 72*a*, and 72*b* and delivery rates of the flow control valves 5*a* to 5*c*. The cylinder speed calculation section 9*m* finds the delivery rates of the flow control valves 5*a* to 5*c* using this relationships. It should be noted that relationships between pilot pressures calculated in advance and cylinder speeds may be stored in the storage device of the control unit 9 to directly find the cylinder speeds from the pilot pressures.

The detection signal selection section 91*a* selects a detection signal to be received by the front posture calculation section 9*b* in accordance with the speed of each of the cylinders calculated by the cylinder speed calculation section 9*m*. If at least one of the detection signals of the tilting angle sensors 81*a* to 81*c* is selected by the detection signal selection section 91*a*, the angle convertor 92*a* converts this signal into at least one of rotation angles α, β, and γ to provide consistency of information with the angle sensors 8*a* to 8*c*. On the other hand, if at least one of the detection signals of the angle sensors 8*a* to 8*c* is selected by the detection signal selection section 91*a*, at least one of rotation angles α, β, and γ is received by the front posture calculation section 9*b* just as it is. A description will be given next of details of processing performed by the detection signal selection section 91*a* and the angle convertor 92*a* with reference to the flowchart illustrated in FIG. 6.

Figure 6:
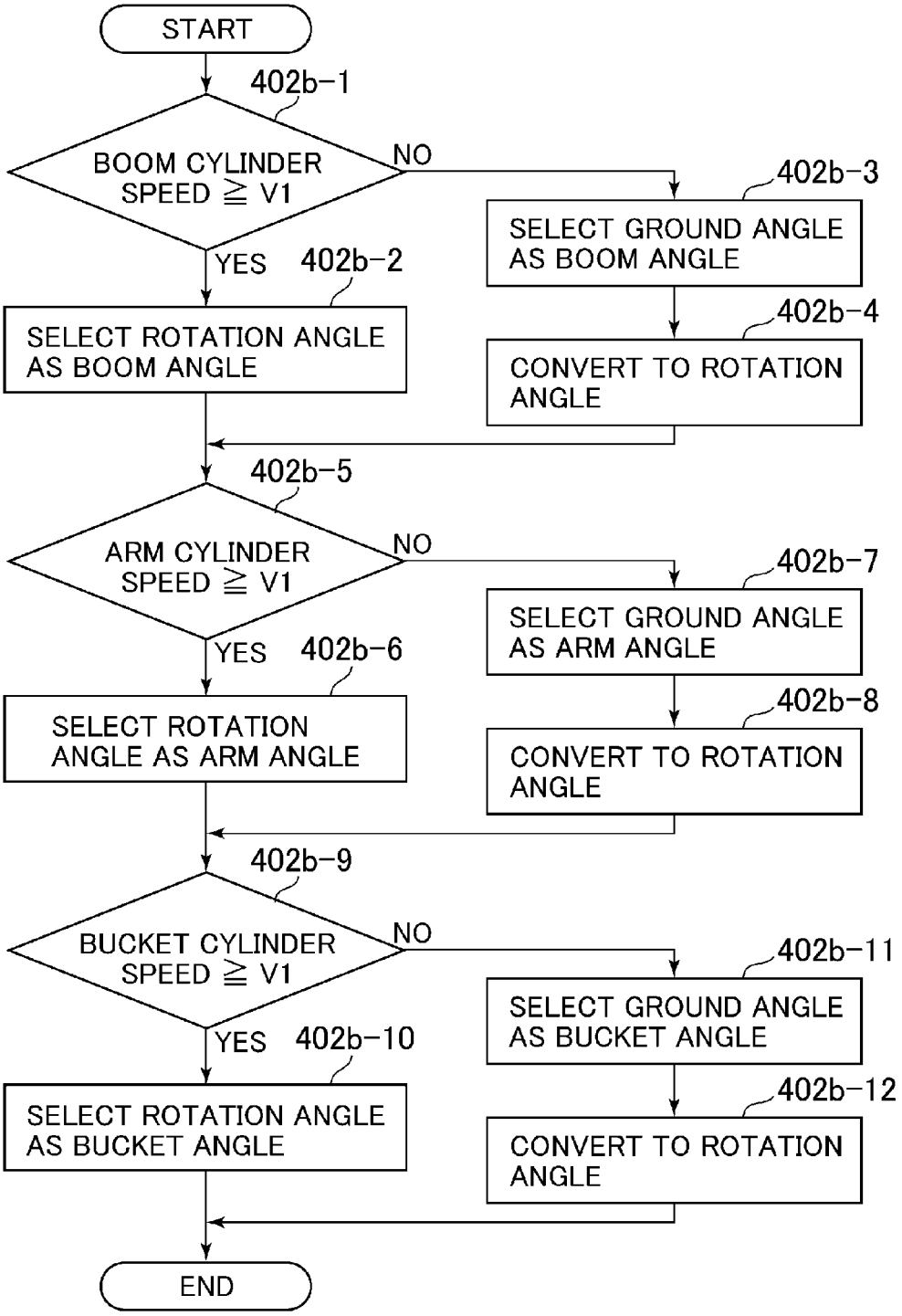
FIG. 6 is a flowchart of processing performed by a detection signal selection section and an angle converter according to a first embodiment of the present invention.

FIG. 6 is a flowchart of processing performed by the detection signal selection section 91*a* and the angle converter 92*a* according to the first embodiment of the present invention. At the start of the processing in FIG. 6, first, the detection signal selection section 91*a* receives a boom cylinder speed from the cylinder speed calculation section 9*m*, judging whether the boom cylinder speed is equal to or higher than a setting value (set speed) V1 (step 402*b*-1). The setting value V1 is determined based on maximum response speeds of the angle sensors 8*a* to 8*c* and the tilting angle sensors 81*a* to 81*c*. In general, the angle sensors (potentiometers) 8*a* to 8*c* offer better responsiveness, and therefore, higher response speeds, than the tilting angle sensors 81*a* to 81*c*. For this reason, the setting value V1 should preferably be a speed at which both the angle sensors 8*a* to 8*c* and the tilting angle sensors 81*a* to 81*c* can respond, and should more preferably be a minimum speed at which the angle sensors 8*a* to 8*c* can respond or a speed close thereto and at the same time a maximum speed at which the tilting angle sensors 81*a* to 81*c* can respond or a speed close thereto. Thus, specifying the setting value V1 as described above eliminates a motion speed that cannot be covered by both the angle sensors 8*a* to 8*c* and the tilting angle sensors 81*a* to 81*c*.

When the boom cylinder speed is equal to or higher than the setting value V1 in step 402*b*-1, the detection signal selection section 91*a* outputs the detected rotation angle detected by the angle sensor 8*a* to the front posture calculation section 9*b* as the boom angle α (step 402*b*-2). On the other hand, when the boom cylinder speed is lower than the setting value V1 in step 402*b*-1, the detection signal selection section 91*a* selects the ground angle detected by the tilting angle sensor 81*a* and outputs this angle to the angle convertor 92*a* (step 402*b*-3). When the ground angle is received, the angle convertor 92*a* outputs an angle, obtained by converting the ground angle into a rotation angle, to the front posture calculation section 9*b* as the boom angle α (step 402*b*-4).

Next, the detection signal selection section 91*a* receives an arm cylinder speed from the cylinder speed calculation section 9*m*, judging whether the arm cylinder speed is equal to or higher than the setting value V1 (step 402*b*-5). When the arm cylinder speed is equal to or higher than the setting value V1 here, the detection signal selection section 91*a* outputs the rotation angle detected by the angle sensor 8*b* to the front posture calculation section 9*b* as the arm angle β (step 402*b*-6). On the other hand, when the arm cylinder speed is lower than the setting value V1 in step 402*b*-5, the detection signal selection section 91*a* selects the ground angle detected by the tilting angle sensor 81*b* and outputs this angle to the angle convertor 92*a* (step 402*b*-7). When the ground angle is received, the angle convertor 92*a* converts this angle into a rotation angle and outputs the angle to the front posture calculation section 9*b* as the arm angle β (step 402*b*-8).

Then, the detection signal selection section 91*a* receives a bucket cylinder speed from the cylinder speed calculation section 9*m*, judging whether the bucket cylinder speed is equal to or higher than the setting value V1 (step 402*b*-9). When the bucket cylinder speed is equal to or higher than the setting value V1 here, the detection signal selection section 91*a* outputs the rotation angle detected by the angle sensor 8*b* to the front posture calculation section 9*b* as the bucket angle γ (step 402*b*-10). On the other hand, when the bucket cylinder speed is lower than the setting value V1 in step 402*b*-9, the detection signal selection section 91*a* selects the ground angle detected by the tilting angle sensor 81*c* and outputs this angle to the angle convertor 92*a* (step 402*b*-11). When supplied with the ground angle, the angle convertor 92*a* converts this angle into a rotation angle and outputs the angle to the front posture calculation section 9*b* as the bucket angle γ (step 402*b*-12). It should be noted that although found in the order from the boom angle α to the arm angle β and to the bucket angle γ in the example illustrated in FIG. 6, the rotation angles may be found in other order.

The front posture calculation section 9*b* calculates a posture of the work implement assembly 1A and a position of each of predetermined portions as XY coordinate values with an origin located, for example, at a rotation fulcrum of the boom 1*a*. The calculation by the front posture calculation section 9*b* is performed using sizes of respective portions of the work implement assembly 1A and the construction machine main body 1B which sizes are stored in the storage device of the control unit 9 and using the rotation angles α, β, and γ detected by the angle sensors 8*a* to 8*c* or the tilting angle sensors 81*a* to 81*c*.

Referring back to FIG. 5, the area setting calculation section 9*a* performs calculations to specify a boundary of a set area within which the tip of the bucket 1*c* can move as instructed by the setting device 7. An example thereof will be described with reference to FIG. 7. It should be noted that although a set area boundary is specified in a vertical plane by a line in the present embodiment, a boundary may be specified by a plane. Further, although a boundary is specified by an operator relative to the tip position of the bucket 1*c* calculated by the front posture calculation section 9*b* as occasion arises in the present embodiment, line data, plane data, or 3D data representing a set area boundary may be used as external reference data.

Figure 7:
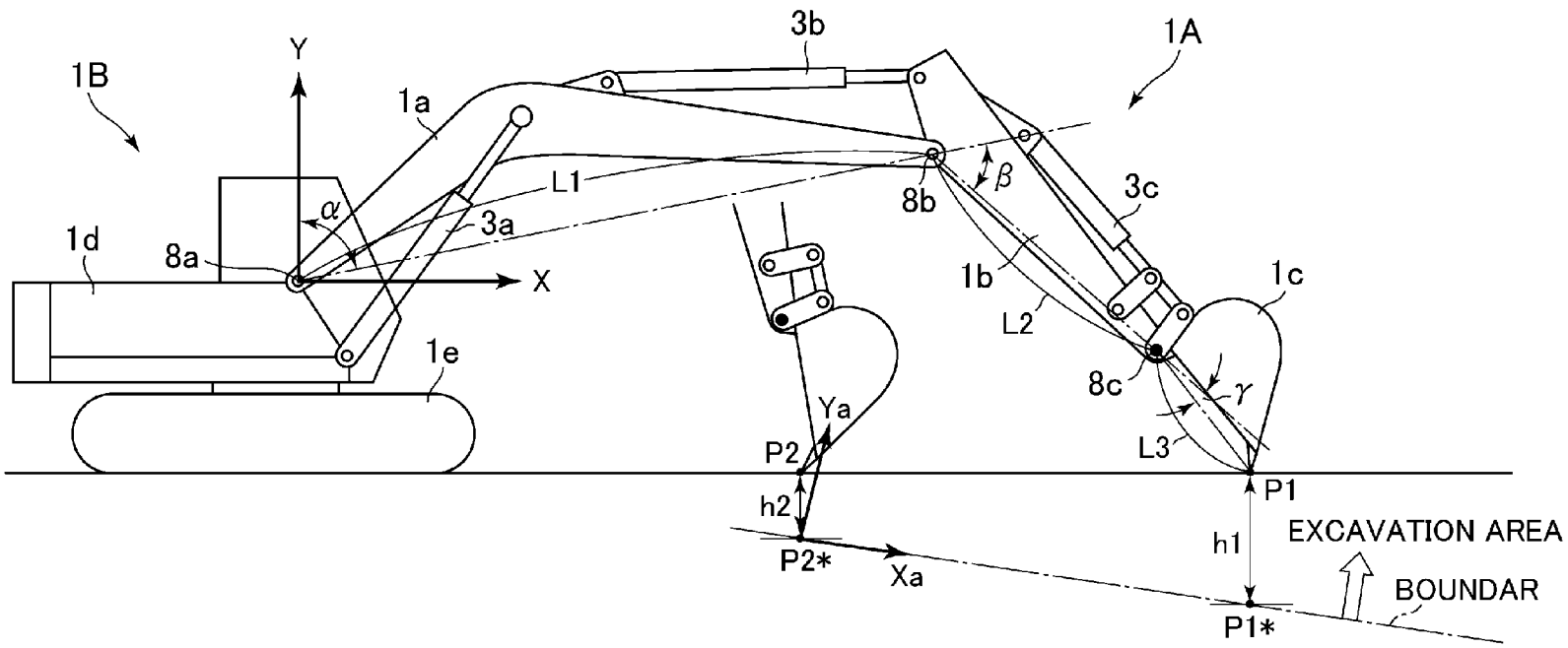
FIG. 7 is a diagram illustrating an approach for setting a coordinate system and an area used for area limiting excavation control.

In FIG. 7, the tip of the bucket 1*c* is moved to a point P1 by the operator first. Then, the tip position of the bucket 1*c* at this time is calculated as instructed by the setting device 7. Next, a depth h1 from that position is entered by manipulating the setting device 7, thus specifying a point P1* that lies on the boundary of the set area to be specified on the basis of the depth. Next, the tip of the bucket 1*c* is moved to a point P2 located closer to the construction machine main body 1B than the point P1 first. Then, the tip position of the bucket 1*c* at this time is calculated as instructed by the setting device 7. Similarly, a depth h2 from that position is entered by manipulating the setting device 7, thus specifying a point P2* that lies on the boundary to be specified on the basis of the depth. Then, a linear equation of a line segment connecting the two points P1* and P2* is calculated for use as a set area boundary (boundary line).

Here, the front posture calculation section 9*b* calculates the positions of the two points P1 and P2, and the area setting calculation section 9*a* calculates the above linear equation using the position information.

The control unit 9 stores the sizes of the respective portions of the work implement assembly 1A and the construction machine main body 1B. The front posture calculation section 9*b* calculates the positions of the two points P1 and P2 using the size data and the rotation angles α, β, and γ obtained from the angle sensors 8*a* to 8*c* or the tilting angle sensors 81*a* to 81*c*. At this time, the positions of the two points P1 and P2 are found, for example, as coordinate values (X1, Y1) and (X2, Y2) of an XY coordinate system having an origin located at a rotation fulcrum of the boom 1*a*. We assume that the XY coordinate system is a rectangular coordinate system fixed in the construction machine main body 1B and lies in a vertical plane. Denoting the distance between the rotation fulcrums of the boom 1*a* and the arm 1*b* by L1, the distance between the rotation fulcrums of the arm 1*b* and the bucket 1*c* by L2, and the distance between the rotation fulcrums of the bucket 1*c* and the tip thereof by L3, the coordinate values (X1, Y1) and (X2, Y2) of the XY coordinate system can be found from the rotation angles α, β, and γ by the following equations:

$$X=L1\sin\alpha+L2\sin(\alpha+\beta)+L3\sin(\alpha+\beta+\gamma)$$

$$Y=L1\cos\alpha+L2\cos(\alpha+\beta)+L3\cos(\alpha+\beta+\gamma)$$

The area setting calculation section 9*a* finds the coordinate values of the two points P1* and P2* lying on the boundary of the set area by performing a calculation Y1*=Y1−h1Y2*=Y2−h2 for the Y coordinate of each of the two points. Further, the linear equation of the line segment connecting the two points P1* and P2* is calculated by the following equation:

$$Y=(Y2^*-Y1^*)X/(X2-X1)+(X2Y1^*-X1Y2^*)/(X2-X1)$$

Then, a rectangular coordinate system having its origin on the above straight line that serves as one of the axes is set. For example, an XaYa coordinate system having its origin at the point P2* is set to find coordinate conversion data for conversion from the XY coordinate system to the XaYa coordinate system.

Further, if the construction machine main body 1B tilts relative to the horizontal plane such as when engaged in work on sloping land, the relative positional relationship between the bucket tip and the ground plane changes, rendering it impossible to specify a set area properly. In the present embodiment, therefore, the tilting angle θ of the construction machine main body 1B is detected by the tilting angle sensor 8*d* and entered using the front posture calculation section 9*b*, and then the bucket tip position is calculated by using an XbYb coordinate system obtained by rotating the XY coordinate system by the angle θ. This permits proper area setting even in the event of tilting of the construction machine main body 1B. It should be noted that tilting angle sensors are not always necessary in a case where, if the vehicle body tilts, work is undertaken after correction of the tilt of the vehicle body or where the vehicle is used in a worksite in which a vehicle body tilt is unlikely to occur.

It should be noted that a set area boundary was specified on the basis of the depths from the two points P1 and P2 having different distances to each other from the construction machine main body 1B in the above example. Therefore, the boundary was defined by a straight line passing through the two points P1* and P2*. However, it is possible to specify a boundary of a desired shape in a vertical plane by specifying a boundary on the basis of depths from three or more points having different distances to each other from the construction machine main body 1B. For example, when specified by three points, an approximately V-shaped boundary can be specified. On the other hand, when specified by four points, an approximately U-shaped boundary can be specified. Further, although specified by a line in a vertical plane in the present embodiment, a boundary may be specified by a plane. Still further, although a boundary is specified by an operator relative to the tip position of the bucket 1*c* calculated by the front posture calculation section 9*b* as occasion arises in the present embodiment, line data, plane data, or 3D data representing a boundary may be used as external reference data.

Referring back to FIG. 5, the target cylinder speed calculation section 9*c* receives pilot pressures detected by the pressure sensors 60*a*, 60*b*, 61*a*, 61*b*, 62*a*, and 62*b* to find delivery rates of the flow control valves 5*a* to 5*c* and further calculate target speeds of the boom cylinder 3*a*, the arm cylinder 3*b*, and the bucket cylinder 3*c* from the delivery rates. The storage device of the control unit 9 stores relationships between pilot pressures detected by the pressure sensors 60*a*, 60*b*, 61*a*, 61*b*, 62*a*, and 62*b* and delivery rates of the flow control valves 5*a* to 5*c*. The target cylinder speed calculation section 9*c* finds the delivery rates of the flow control valves 5*a* to 5*c* using this relationship. It should be noted that relationships between pilot pressures calculated in advance and target cylinder speeds may be stored in the storage device of the control unit 9 to directly find the target cylinder speeds from the pilot pressures.

The target tip speed vector calculation section 9*d* finds a target speed vector Vc of the tip of the bucket 1*c* from the bucket tip position found by the front posture calculation section 9*b*, the target cylinder speed found by the target cylinder speed calculation section 9*c*, and the sizes of the respective portions such as L1, L2, and L3 stored in the storage device of the control unit 9. At this time, the target speed vector Vc is found as coordinate values of the XY coordinate system illustrated in FIG. 7 first. Next, these coordinate values are converted into those of the XaYa coordinate system using conversion data from the XY coordinate system to the XaYa coordinate system found earlier by the area setting calculation section 9*a*, thus allowing the coordinate values of the XaYa coordinate system to be found. Here, an Xa coordinate value Vcx of the target speed vector Vc of the XaYa coordinate system is a vector component parallel to the boundary of the set area of the target speed vector Vc, whereas a Ya coordinate value Vcy is a vector component vertical to the boundary of the set area of the target speed vector Vc.

When the tip of the bucket 1*c* is located within the set area and near the boundary of the set area, and if the target speed vector Vc has a component in a direction of approaching the boundary of the set area, the direction conversion control section 9*e* corrects the vertical vector component such that the closer to the boundary of the set area, the smaller the vertical vector component. In other words, a smaller vector pointing in the direction of separating from the set area (opposite direction vector) is added to the vertical vector component Vcy.

Figure 8:
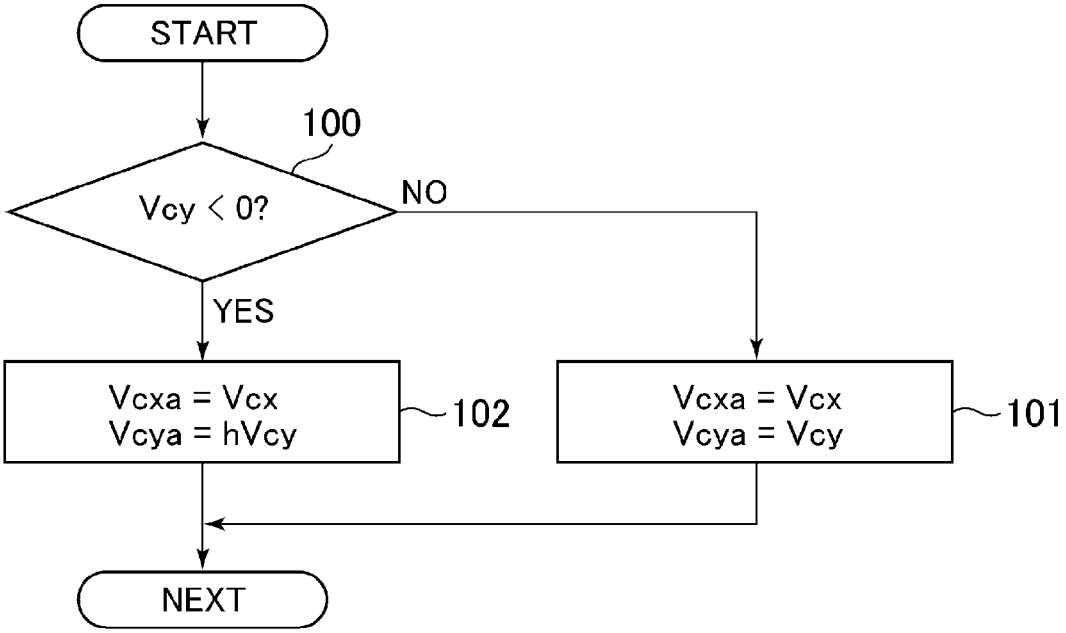
FIG. 8 is a flowchart illustrating contents of processing executed by a direction conversion control section.

FIG. 8 illustrates a flowchart of control contents executed by the direction conversion control section 9*e*. First, the same section 9*e* judges in step S100 whether the component of the target speed vector Vc vertical to the boundary of the set area, i.e., the coordinate value Vcy in the XaYa coordinate system, is positive or negative. When the coordinate value Vcy is positive, the speed vector points in the direction of moving the bucket tip away from the boundary of the set area. Therefore, the direction conversion control section 9*e* proceeds to step 101 where the Xa coordinate value Vcx and the Ya coordinate value Vcy of the target speed vector Vc are used as corrected vector components Vcxa and Vcya just as it is. When the coordinate Vcy is negative, the speed vector points in the direction of moving the bucket tip closer to the boundary of the set area. Therefore, the direction conversion control section 9*e* proceeds to step 102 where the Xa coordinate value Vcx of the target speed vector Vc is used as the corrected vector component Vcxa just as it is. The product of Ya coordinate value Vcy multiplied by a factor h ($0 \leq h \leq 1$) is used as the corrected vector component Vcya.

Here, the factor h is a variable that changes between 0 and 1 with change in a distance Ya between the tip of the bucket 1*c* and the boundary of the set area. More specifically, the factor h is 1 when the distance Ya between the tip of the bucket 1*c* and the boundary of the set area is larger than a setting value Ya1. When the distance Ya is smaller than the setting value Ya1, the smaller the distance Ya, the smaller the factor h is than 1. When the distance Ya is 0, that is, when the bucket tip reaches the boundary of the set area, the factor h is 0. The storage device of the control unit 9 stores such a relationship between h and Ya.

The direction conversion control section 9*e* converts the tip position of the bucket 1*c* found by the front posture calculation section 9*b* using the conversion data for conversion from the XY coordinate system to the XaYa coordinate system found earlier by the area setting calculation section 9*a*. Then, the direction conversion control section 9*e* finds the distance Ya between the tip of the bucket 1*c* and the boundary of the set area, thus finding the factor h using the relationship between the distance Ya and the setting value Ya1.

Correction of the vertical vector component Vcy of the target speed vector Vc as described above reduces the vector component Vcy such that the smaller the distance Ya, the larger a decrement of the vertical vector component Vcy, thus correcting the target speed vector Vc to be equal to a target speed vector Vca. The area having the breadth of the distance Ya1 from the boundary of the set area may be referred to as a direction conversion area or deceleration area (refer to FIG. 9).

Figure 9:
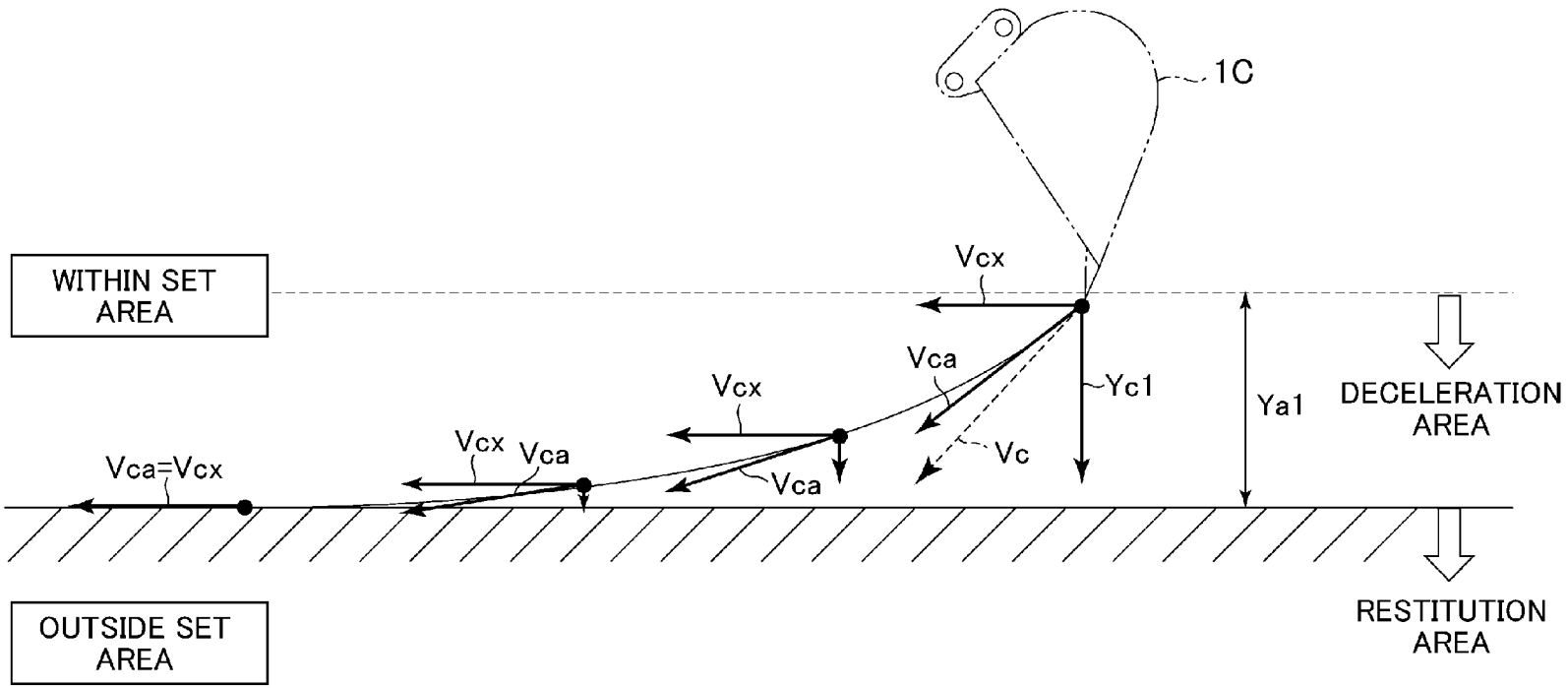
FIG. 9 is a diagram illustrating an example of a path traced by a tip of a bucket when the bucket tip is controlled as calculated through direction conversion control.

FIG. 9 illustrates an example of a path traced by the tip of the bucket 1*c* when the bucket tip is controlled in accordance with the target speed vector Vca corrected as above through direction conversion control. Assuming that the target speed vector Vc is constant in a diagonally downward direction, the parallel component Vcx thereof is constant, and the closer the tip of the bucket 1*c* to the boundary of the set area (the smaller the distance Ya), the smaller the vertical component Vcy. The corrected target speed vector Vca is a composition of the above two components. Therefore, the path of the corrected target speed vector Vca is in the form of a curve that runs parallel to the boundary of the set area as it approaches the boundary as illustrated in FIG. 9. Further, setting Ya=0 and h=0, the corrected target speed vector Vca matches the parallel component Vcx on the boundary of the set area.

It should be noted that even if the vertical component of the target speed vector of the bucket tip is reduced as described above, it is extremely difficult to bring the vertical component down to 0 when the vertical distance Ya=0 because, for example, of variations in manufacturing tolerances of the flow control valves and other hydraulic equipment, resulting in the bucket tip erroneously finding its way into the non-set area. In the present embodiment, however, restitution control described later is used in combination. This ensures that the bucket tip moves approximately on the boundary of the set area at nearly all times. Further, although the above control maintains the horizontal component (Xa coordinate value) of the target speed vector constant, it is not always necessary to do so. The horizontal component may be increased for faster motion, or reduced for slower motion.

The corrected target cylinder speed calculation section 9*f* calculates corrected target cylinder speeds of the boom cylinder 3*a* and the arm cylinder 3*b* from the corrected target tip speed vector found by the direction conversion control section 9*e*. This is the reverse of the calculation performed by the target tip speed vector calculation section 9*d*.

Here, if direction conversion control (deceleration control) in step 102 of the flowchart illustrated in FIG. 8 is performed, the motion directions of the boom cylinder and the arm cylinder required for the direction conversion control are selected, and the target cylinder speed in these directions is calculated. A description will be given, as an example, of a case where the arm is crowded (arm crowding operation) to excavate toward the vehicle body side direction and another case where the boom lowering and the arm damping are performed in combination to move the bucket tip in the pushing direction (arm damping combined operation).

In the case of arm crowding operation, there are three possible approaches to reducing the vertical component Vcy of the target speed vector Vc, namely, (1) by raising the boom 1*a*, (2) by crowding the arm 1*b* more slowly, and (3) by combining both. In the case of (3), the combination ratio between the two approaches varies depending on the posture of the work implement assembly, the horizontal vector component, and other factors. In any case, these are determined by control software. In the present embodiment, direction conversion control is used in combination with restitution control. Therefore, approach (1) or (3) that includes reducing the vertical component Vcy by raising the boom 1*a* is considered preferred, and approach (3) the most preferred because of smooth motion.

In the arm damping combined operation, a target vector is given that points in the direction of moving the arm from a vehicle body side position (forward position) to outside the set area in the case of arm damping. In order to reduce the vertical component Vcy of the target speed vector Vc, therefore, it is necessary to switch from the boom lowering to the boom raising to reduce speed of the arm damping. The combination thereof is determined by control software.

The restitution control section 9*g* corrects the target speed vector such that when the tip of the bucket 1*c* moves out of the set area, the bucket tip returns into the set area in relation to the distance from the boundary of the set area. In other words, a larger vector pointing in the direction of approaching the set area (opposite direction vector) is added to the vertical vector component Vcy.

Figure 10:
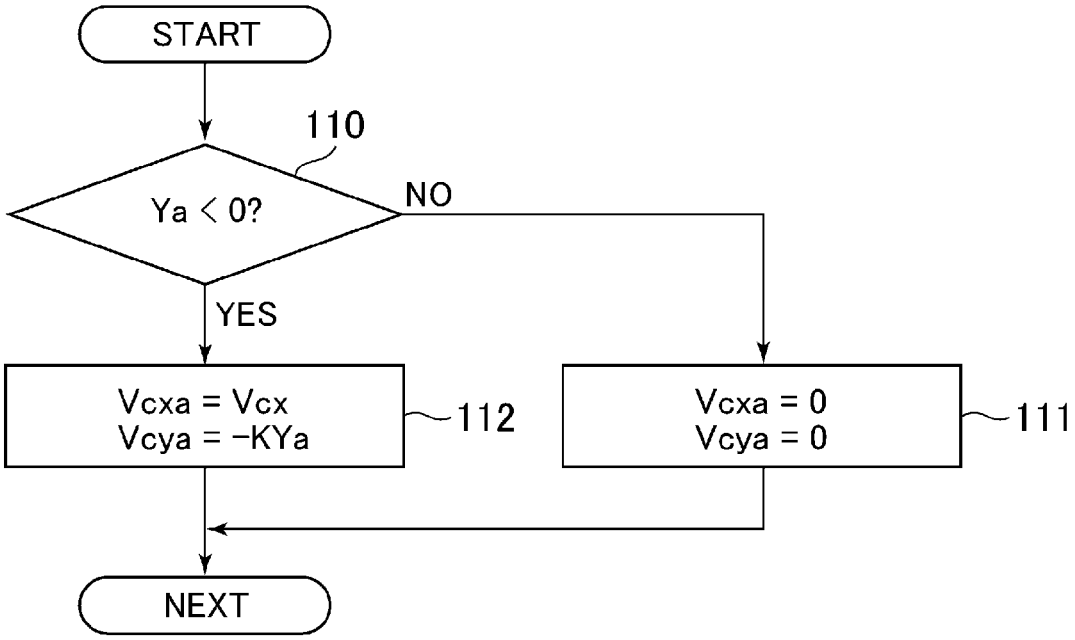
FIG. 10 is a flowchart illustrating contents of processing executed by a restitution control section.

FIG. 10 illustrates a flowchart of control contents executed by the restitution control section 9*g*. First, the restitution control section 9*g* judges in step S110 whether the distance between the tip of the bucket 1*c* and the boundary of the set area is positive or negative. Here, in order to find the distance Ya, the tip position of the front of the work implement assembly found by the front posture calculation section 9*b* is converted using the conversion data for conversion from the XY coordinate system to the XaYa coordinate system. The Ya coordinate value found from the above is used to find the distance Ya. When the distance Ya is positive, the bucket tip is still inside the set area. Therefore, the restitution control section 9*g* proceeds to step 111 where the Xa coordinate value Vcx and the Ya coordinate value Vcy of the target speed vector Vc are both set to 0 because direction conversion control described above takes priority. When the distance Ya is negative, the bucket tip has moved out of the set area. Therefore, the restitution control section 9*g* proceeds to step 112 where the Xa coordinate value Vcx of the target speed vector Vc remains unchanged for use as the corrected vector component Vcxa and the Ya coordinate value Vcy, obtained by multiplying the distance Ya to the boundary of the set area by a factor −K, is used as the corrected vector component Vcya for restitution control. Here, the factor K is an arbitrary value determined from control characteristics. −KYa is a speed vector in the opposite direction that diminishes with decrease in the distance Ya. It should be noted that K may be a function that diminishes with decrease in the distance Ya. In this case, −KVcy diminishes to a greater extent with decrease in the distance Ya.

Correction of the vertical vector component Vcy of the target speed vector Vc as described above corrects the target speed vector Vc to be equal to the target speed vector Vca such that the smaller the target Ya, the smaller the vertical vector component Vcy.

Figure 11:
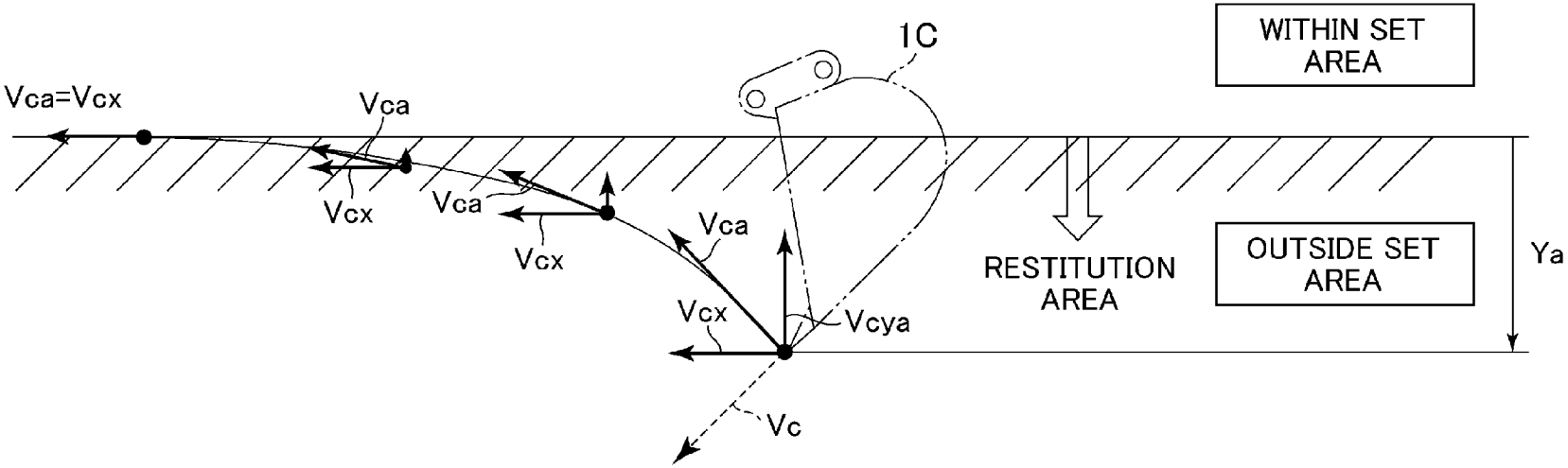
FIG. 11 is a diagram illustrating an example of a path traced when the bucket tip is controlled as calculated through restitution control.

FIG. 11 illustrates an example of a path traced by the tip of the bucket 1*c* when the bucket tip is controlled in accordance with the corrected target speed vector Vca as above through restitution control. Assuming that the target speed vector Vc is constant in a diagonally downward direction, the parallel component Vcx thereof is constant, and the restitution vector component Vcya (−KYa) is proportional to the distance Ya. Therefore, the closer the tip of the bucket 1*c* to the boundary of the set area (the smaller the distance Ya), the smaller the vertical component. The corrected target speed vector Vca is a composition of the above two components. Therefore, the path thereof is in the form of a curve that runs parallel to the boundary of the set area as it approaches the boundary as illustrated in FIG. 11.

The restitution control section 9*g* controls the tip of the bucket 1*c* such that the tip returns into the set area, thus providing a restitution area outside the set area. Further, in this restitution control, a motion in the direction of bringing the tip of the bucket 1*c* closer to the boundary of the set area is decelerated, thus transforming the motion direction of the tip of the bucket 1*c* into a direction along the boundary of the set area. In this sense, the present restitution control may also be called direction conversion control.

The corrected target cylinder speed calculation section 9*h* calculates corrected target cylinder speeds of the boom cylinder 3*a* and the arm cylinder 3*b* from the corrected target tip speed vector found by the restitution control section 9*g*. This is the reverse of the calculation performed by the target tip speed vector calculation section 9*d*.

Here, if restitution control in step 112 of the flowchart illustrated in FIG. 10 is performed, the motion directions of the boom cylinder and the arm cylinder required for the restitution control are selected, and the target cylinder speed in these directions is calculated. It should be noted, however, that because restitution control brings the bucket tip back into the set area by raising the boom 1*a*, the raising direction of the boom 1 is always included. The combination thereof is determined by control software.

The target cylinder speed selection section 9*i* selects the larger of the two target cylinder speeds (maximums), one obtained by the corrected target cylinder speed calculation section 9*f* through direction conversion control and another obtained by the corrected target cylinder speed calculation section 9*h* through restitution control, for use as a target cylinder speed to be output.

Here, when the distance Ya between the bucket tip and the boundary of the set area is positive, both of the target speed vector components are set to 0 in step 111 of FIG. 10. As a result, the speed vector components in step 101 or 102 of FIG. 8 are always larger. Therefore, the target cylinder speed obtained by the corrected target cylinder speed calculation section 9*f* through direction conversion control is selected. When the distance Ya is negative, and when the vertical vector component Vcy of the target speed vector is negative, h=0 in step 102 of FIG. 8, and the corrected vertical component Vcya is 0. As a result, the vertical component in step 112 of FIG. 10 is always larger. Therefore, the target cylinder speed obtained by the corrected target cylinder speed calculation section 9*h* through restitution control is selected. When the distance Ya is negative, and when the vertical vector component Vcy is positive, the target cylinder speed obtained by the corrected target cylinder speed calculation section 9*f* or 9*h* is selected in accordance with the magnitude of the values of the two vertical components, namely, the vertical component Vcy of the target speed vector Vc in step 101 of FIG. 8 and the vertical component KYa in step 112 of FIG. 10. It should be noted that the target cylinder speed selection section 9*i* may use other approach such as summing the two values rather than selecting the maximum value.

The target pilot pressure calculation section 9*j* calculates target pilot pressures of the pilot lines 44*a* and 44*b*, 45*a* and 45*b*, and 46*a* and 46*b* from the target cylinder speeds to be output obtained from the target cylinder speed selection section 9*i*. This is the reverse of the calculation performed by the target cylinder speed calculation section 9*c*.

The valve instruction calculation section 9*k* calculates instructed pressure values of the proportional solenoid valves 10*a*, 10*b*, 11*a*, 11*b*, 13*a*, and 13*b* that provide pilot pressures from, the target pilot pressures calculated by the target pilot pressure calculation section 9*j*. These instructed pressure values are amplified by amplifiers and output to the proportional solenoid valves 10*a*, 10*b*, 11*a*, 11*b*, 13*a*, and 13*b* as electric signals. As a result, direction conversion control illustrated in FIG. 9 or restitution control illustrated in FIG. 11 is conducted, thus allowing area limiting control to be performed that forms an excavation surface along the boundary of the set area.

In the construction machine configured as described above, the front posture calculation section 9*b* uses the rotation angles α, θ, and γ of the boom 1*a*, the arm 1*b*, and the bucket 1*c* to calculate the posture of the work implement assembly 1A and the position of a predetermined portion (e.g., bucket tip position). In this instance, the sensors that supply these rotation angles α, β, and γ are selected in accordance with the speeds of the boom cylinder 3*a*, the arm cylinder 3*b*, and the bucket cylinders 3*c*. More specifically, when the cylinder speed is equal to or higher than the setting value V1, the detection signals of the angle sensors 8 that offer excellent responsiveness are used. When the cylinder speed is lower than the setting value V1, the detection signals of the tilting angle sensors 81 that offer high accuracy are used. Thus, selecting the sensors for use in calculation of the rotation angles α, β, and γ in accordance with the cylinder speeds contributes to improved accuracy in calculation of the posture of the work implement assembly 1A and the position of a predetermined portion when any of the cylinder speeds is lower than the setting value V1. As is obvious from FIG. 5, in area limiting excavation control according to the present embodiment, the output of the front posture calculation section 9*b* is used by many other components, namely, the area setting calculation section 9*a*, the target tip speed vector calculation section 9*d*, the direction conversion control section 9*e*, the restitution control section 9*g*, and the corrected target cylinder speed calculation sections 9*f* and 9*h*, ensuring significantly improved accuracy in area limiting excavation control. This is advantageous, for example, in that it is easier to finish an excavation surface flat quickly regardless of operator's degree of skill by moving the work implement assembly slowly when putting finishing touches to the excavation surface.

In the above embodiment, the sensors to be used are selected in accordance with the respective speeds of the boom cylinder 3*a*, the arm cylinder 3*b*, and the bucket cylinder 3*c*. However, if any of the boom 1*a*, the arm 1*b*, and the bucket 1*c* (driven members) that are linearly connected through pins to the construction machine main body 1B has a cylinder speed equal to or higher than the setting value V1 (that is a fast motion member), the detection signals of the angle sensors 8 may be used for the rotation angles between the fast motion member and all the driven members connected farther away from the construction machine main body 1B than the fast motion member, and the detection signals of the tilting angle sensors 81 may be used for the rotation angles of the remaining driven members. A description will be given next of this case as a second embodiment. It should be noted that the second embodiment differs from the first embodiment only in that processing performed by the detection signal selection section 91*a* and the angle convertor 92*a* are different from those in the first embodiment, and that the same components are used. Therefore, the description thereof will be omitted.

Figure 12:
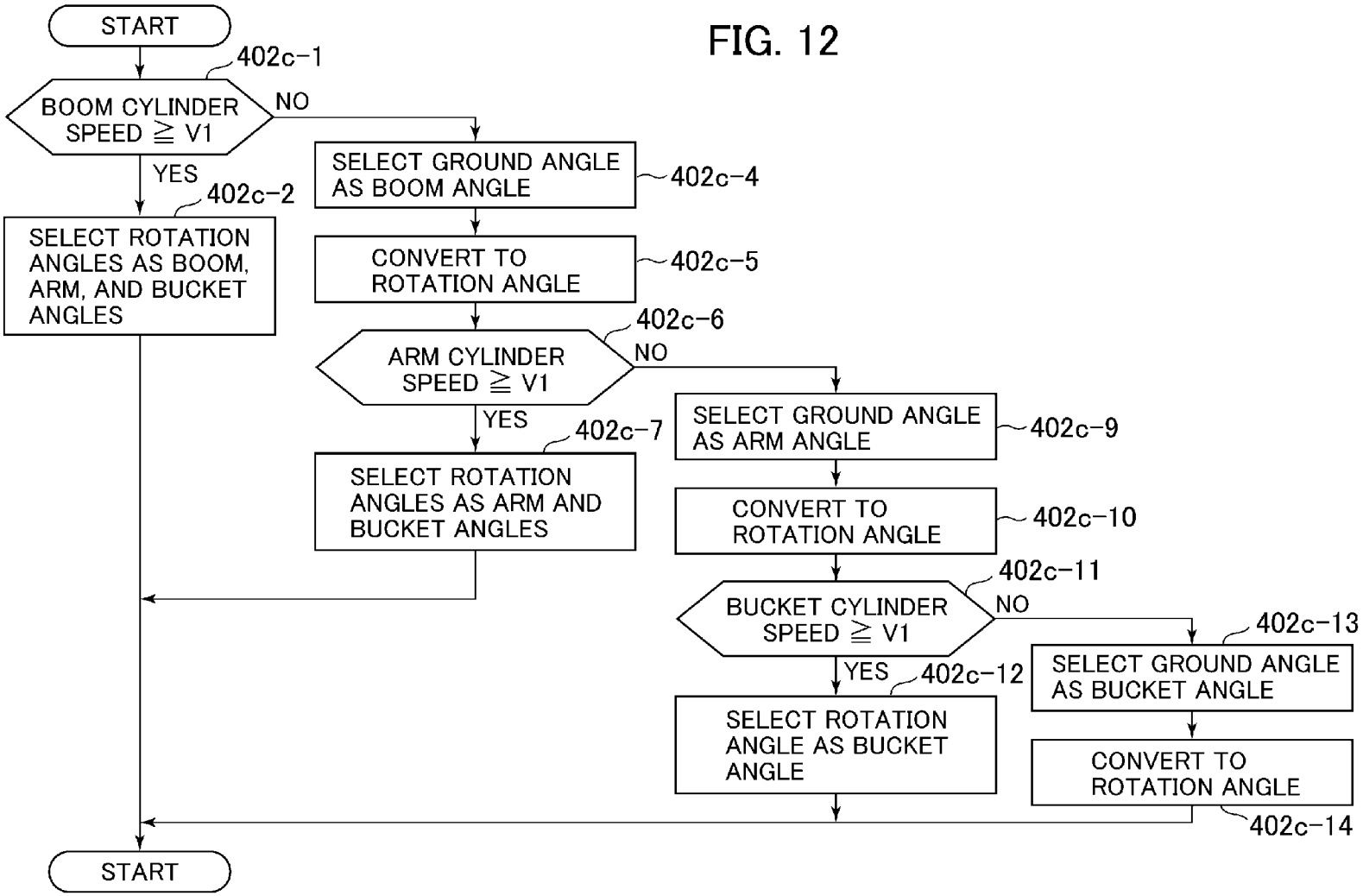
FIG. 12 is a flowchart of processing performed by the detection signal selection section and the angle converter according to a second embodiment of the present invention.
Figure 13:
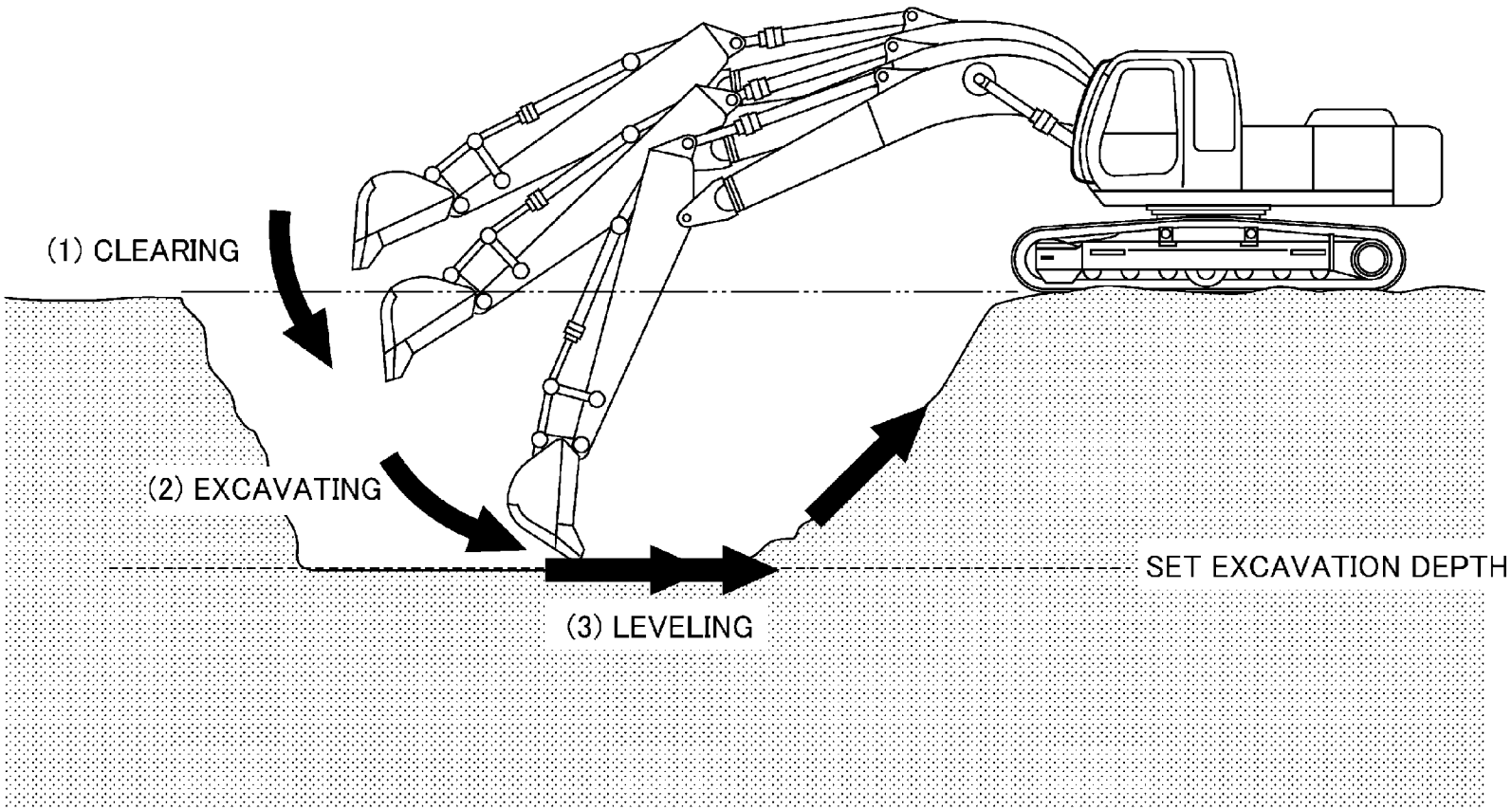
FIG. 13 is an explanatory diagram of operation when area limiting control is performed in the hydraulic excavator.

FIG. 12 is a flowchart of processing performed by the detection signal selection section 91*a* and the angle convertor 92*a* according to the second embodiment of the present invention. At the start of the processing in FIG. 12, the detection signal selection section 91*a* receives the boom cylinder speed from the cylinder speed calculation section 9*m* first, judging whether the boom cylinder speed is equal to or higher than the setting value V1 (step 402*c*-1). Here, when the boom cylinder speed is equal to or higher than the setting value V1, the detection signal selection section 91*a* outputs, to the front posture calculation section 9*b*, the rotation angles of not only the boom 1*a* but also those of the arm 1*b* and the bucket 1*c* connected far from the construction machine main body 1B relative to the boom 1*a* in terms of a link mechanism, the rotation angles having been detected by the angle sensors 8*a* to 8*c*, as the angles α, β, and γ of the respective driven members (step 402*c*-2), and then terminates the processing.

When the boom cylinder speed is lower than the setting value V1 in step 402*c*-1, the detection signal selection section 91*a* selects the ground angle detected by the tilting angle sensor 81*a* as a boom angle (step 402*c*-4). This angle is converted into a rotation angle by the angle convertor 92*a*. The detection signal selection section 91*a* outputs the resultant angle to the front posture calculation section 9*b* as the boom angle α (step 402*c*-5). Then, the detection signal selection section 91*a* receives the arm cylinder speed from the cylinder speed calculation section 9*m*, judging whether the arm cylinder speed is equal to or higher than the setting value V1 (step 402*c*-6). Here, when the arm cylinder speed is equal to or higher than the setting value V1, the detection signal selection section 91*a* outputs, to the front posture calculation section 9*b*, the rotation angles of not only the arm 1*b* but also that of the bucket 1*c* connected far from the construction machine main body 1B relative to the arm 1*b* in terms of a link mechanism, the rotation angles having been detected by the angle sensors 8*b* and 8*c*, as the angles β and γ of the respective driven members (step 402*c*-7), and then terminates the processing.

When the arm cylinder speed is lower than the setting value V1 in step 402*c*-6, the detection signal selection section 91*a* selects the ground angle detected by the tilting angle sensor 81*b* as an arm angle (step 402*c*-9). This angle is converted into a rotation angle by the angle convertor 92*a*. The detection signal selection section 91*a* outputs the resultant angle to the front posture calculation section 9*b* as the arm angle β (step 402*c*-10). Then, the detection signal selection section 91*a* receives the bucket cylinder speed from the cylinder speed calculation section 9*m*, judging whether the bucket cylinder speed is equal to or higher than the setting value V1 (step 402*c*-11). Here, when the bucket cylinder speed is equal to or higher than the setting value V1, the detection signal selection section 91*a* outputs, to the front posture calculation section 9*b*, the rotation angle detected by the angle sensor 8*c* as the bucket angle γ (step 402*c*-12), and then terminates the processing.

On the other hand, when the bucket cylinder speed is lower than the setting value V1 in step 402*c*-11, the detection signal selection section 91*a* selects the ground angle detected by the tilting angle sensor 81*c* as a bucket angle (step 402*c*-13). This angle is converted into a rotation angle by the angle convertor 92*a*. The detection signal selection section 91*a* outputs the resultant angle to the front posture calculation section 9*b* as the bucket angle γ (step 402*c*-14), and then terminates the processing.

When a construction machine has the boom 1*a*, the arm 1*b*, and the bucket 1*c* (driven members) connected linearly in terms of a link mechanism, with the construction machine main body 1B as the base end, as a hydraulic excavator, the presence of a driven member whose speed is equal to or higher than the setting value V1 halfway through the straight line (fast motion member) increases the motion speeds of other driven members located far, in the straight line, from the construction machine main body 1B relative to the fast motion member. Therefore, even if relative speeds of the other driven members relative to the fast motion member are lower than the setting value V1, and even if the detection signals of the tilting angle sensors 81 should be used based on the flowchart of FIG. 6 of the first embodiment, the absolute speeds of the other driven members exceed the setting value V1. As a result, using the tilting angle sensors 81 that offer poorer responsiveness may result in degraded accuracy due to faulty detection. However, when the control unit is configured in the present embodiment, the detection signals of the angle sensors 8 are used to calculate the angles of all the driven members located on a side separating from the fast motion member in the straight line, thus avoiding faulty detection and preventing degraded accuracy.

If area limiting control is used in a hydraulic excavator, a series of motions, namely, (1) clearing, (2) excavating, and (3) leveling, is repeated. Of these motions, the present embodiment is used during (1) clearing and (3) leveling. The present embodiment is particularly effective when applied to hydraulic excavators. More specifically, the lowering speed of the boom 1*a* is equal to or higher than the setting value V1 during the clearing motion. However, the speeds of the arm 1*b* and the bucket 1*c* do not exceeds the setting value V1. In the case of the flowchart of FIG. 6, therefore, the angle sensor 8*a* is used for the boom 1*a*, and the angle sensors 8*b* and 8*c* are used for the arm 1*b* and the bucket 1*c*. In the present embodiment, however, control passes through step 402*c*-2 of FIG. 12. Therefore, the angle sensors 8 are used in all cases, thus avoiding faulty detection during angle detection of the arm 1*b* and the bucket 1*c* because of the boom 1*a* that moves fast. Further, the speeds of the boom 1*a* and the bucket 1*c* are lower than the setting value V1, and the speed of the arm 1*b* is equal to or higher than the setting value V1 during (3) leveling. In the case of the flowchart of FIG. 6, therefore, the angle sensor 8*b* is used for the arm 1*b*, and the tilting angle sensors 81*a* and 81*c* are used for the boom 1*a* and the bucket 1*c*. In the present embodiment, however, control passes through step 402*c*-7 of FIG. 12. Therefore, the tilting angle sensor 81*a* is used only for the boom 1*a*, and the angle sensors 8*b* and 8*c* are used for the arm 1*b* and the bucket 1*c*, thus avoiding faulty detection during angle detection of the bucket 1*c* because of the arm 1*b* that moves fast.

Incidentally, although, in the above two embodiments, whether to use the angle sensors 8 or the tilting angle sensors 81 is determined in accordance with the speeds of the boom 1*a*, the arm 1*b*, and the bucket 1*c*, the sensors may be selected in accordance with the bucket tip speed. This case will be described below as a third embodiment.

Figure 14:
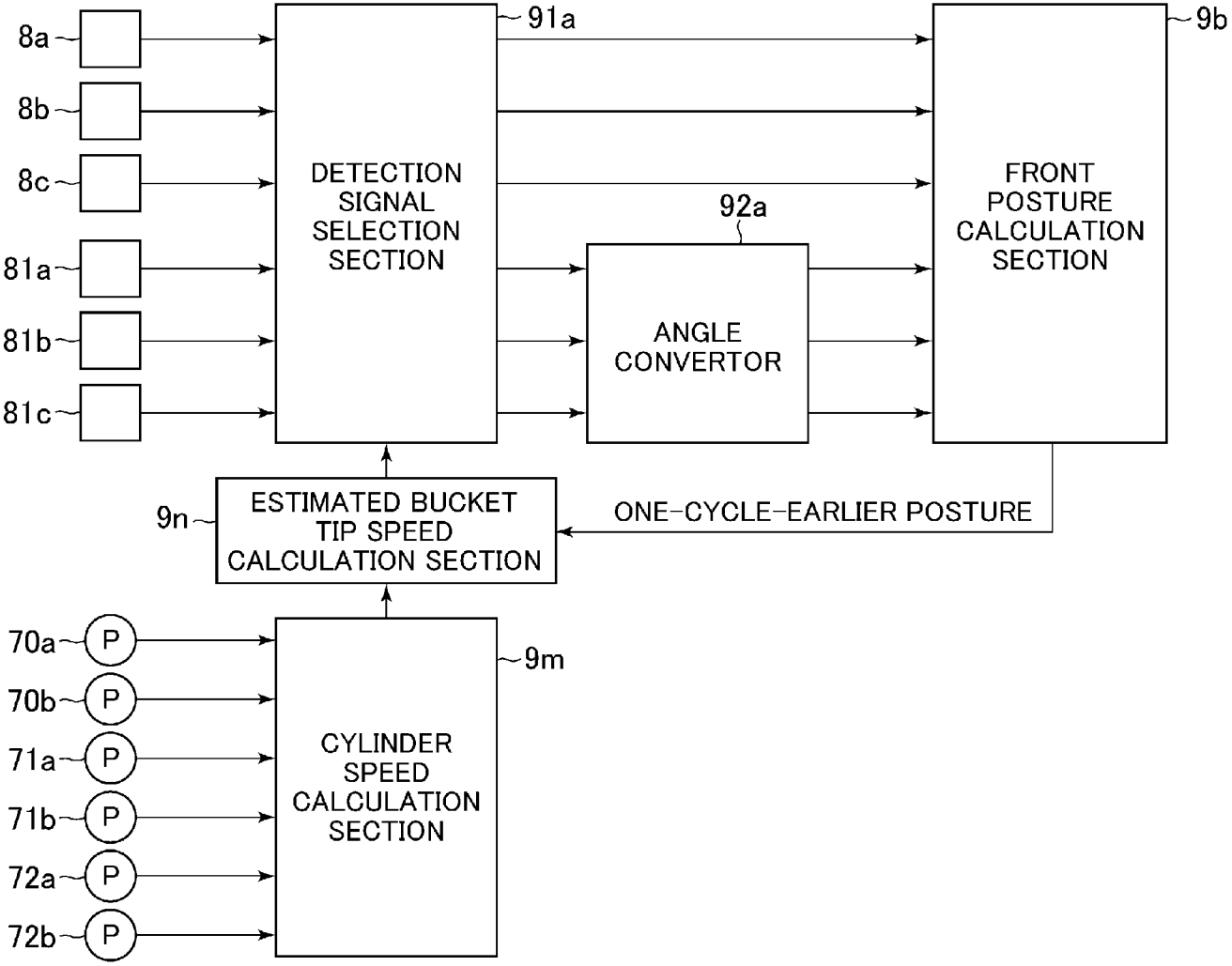
FIG. 14 is a functional block diagram illustrating some of the control functions of the control unit according to a third embodiment of the present invention.

FIG. 14 is a functional block diagram illustrating some of the control functions of the control unit 9 according to a third embodiment of the present invention. The control unit 9 illustrated in FIG. 14 includes an estimated bucket tip speed calculation section 9*n*. The estimated bucket tip speed calculation section 9*n* receives a one-cycle-earlier posture (assuming "START" to "RETURN" in FIG. 15 described later as one cycle (one control period)) from the front posture calculation section 9*b*. Further, the estimated bucket tip speed calculation section 9*n* receives bucket, arm, and bucket cylinder speeds from the cylinder speed calculation section 9*m*. The estimated bucket tip speed calculation section 9*n* calculates an estimated bucket tip speed based on the above information ahead of the direction conversion control section 9*e* and the restitution control section 9*g*. One cycle period should preferably be set as short as possible to ensure that the calculation of the estimated bucket tip speed based on a one-cycle-earlier posture is not affected.

It should be noted that the components of the control unit 9 in FIG. 14 other than the above are the same as those illustrated in FIG. 4. Then, we assume that the control unit 9 according to the present embodiment has not only the functions illustrated in FIG. 14 but also the functions identical to those illustrated in FIG. 5.

FIG. 15 is a flowchart of processing performed by the area limiting excavation control system for construction machines according to the third embodiment of the present invention. The control unit 9 starts the processing in FIG. 15 when the engine key is turned on, checking a flag to determine whether the one-cycle-earlier posture of the work implement assembly 1A is stored (step 601). The flag is selectively set to 0 or 1. When the flag is 1, this means that a one-cycle-earlier posture of the work implement assembly 1A is stored. When the flag is 0, this means that a one-cycle-earlier posture of the work implement assembly 1A is not stored because the hydraulic excavator has just been started up.

When the flag is 0 in step 601 (i.e., first cycle), 1 is entered into the flag in step 602. At this time, the hydraulic excavator has just been started up. Therefore, the operating units 4*a* to 4*c* have yet to be operated. As a result, the readings of the pressure sensors 70*a*, 70*b*, 71*a*, 71*b*, 72*a*, and 72*b* are zero. That is, the bucket tip speed is zero. As a result, the control unit 9 proceeds to step 607.

In step 607, the detection signal selection section 91*a* selects ground angles output from the tilting angle sensors 81*a* to 81*c* and outputs these angles to the angle convertor 92*a*. When the ground angles are received, the angle convertor 92*a* converts them into rotation angles and outputs the angles to the front posture calculation section 9*b* as the boom, arm, and bucket angles α, β, and γ (step 608), and then proceeds to step 609.

When the flag is 1 in step 601 (i.e., second cycle onwards), the cylinder speed calculation section 9*m* receives pilot pressure values detected by the pressure sensors 70*a*, 70*b*, 71*a*, 71*b*, 72*a*, and 72*b* to find delivery rates of the flow control valves 5*a* to 5*c* and further calculate speeds of the boom, arm, and bucket cylinders 3*a*, 3*b*, and 3*c*, outputting these speeds to the estimated bucket tip speed calculation section 9*n* (step 603).

In step 604, the estimated bucket tip speed calculation section 9*n* calculates an estimated bucket tip speed based on the one-cycle-earlier posture received from the front posture calculation section 9*b* and the speeds of the respective cylinders 3*a*, 3*b*, and 3*c* calculated in step 603, outputting the estimated bucket tip speed to the detection signal selection section 91*a*.

When the estimated bucket tip speed is received, the detection signal selection section 91*a* judges whether the estimated bucket tip speed is equal to or higher than the setting value V1 (step 605). Here, when the estimated bucket tip speed is equal to or higher than the setting value V1, the detection signal selection section 91*a* outputs, to the front posture calculation section 9*b*, the rotation angles detected by the angle sensors 8*a* to 8*c*, as the boom, arm, and bucket angles α, β, and γ (step 606), and then proceeds to step 609.

On the other hand, when the estimated bucket tip speed is lower than the setting value V1, the detection signal selection section 91*a* proceeds to steps 607 and 608 described above where the rotation angles converted from the ground angles detected by the tilting angle sensors 81*a* to 81*c* are output to the front posture calculation section 9*b*.

Subsequent processing from step 609 to step 616 are the same as the processing described above that are handled by the front posture calculation section 9*b*, the target cylinder speed calculation section 9*c*, the target tip speed vector calculation section 9*d*, the direction conversion control section 9*e*, the corrected target cylinder speed calculation section 9*f*, the restitution control section 9*g*, the corrected target cylinder speed calculation section 9*h*, the target cylinder speed selection section 9*i*, the target pilot pressure calculation section 9*j*, and the valve instruction calculation section 9*k*. However, these processing will be described briefly. It should be noted that we assume that a boundary set processing for a set area has already been specified by the area setting calculation section 9*a*, and that the description thereof will be omitted here.

In step 609, the front posture calculation section 9*b* calculates the posture of the work implement assembly 1A and the bucket tip position based on the rotation angles α, β, and γ received in step 606 or 608. In step 610, the target tip speed vector calculation section 9*d* finds the target speed vector of the tip of the bucket 1*c* (target tip speed vector) Vc from the bucket tip position found by the front posture calculation section 9*b*, the target cylinder speed found by the target cylinder speed calculation section 9*c*, and the sizes of the respective portions such as L1, L2, and L3 stored in the storage device of the control unit 9.

In step 611, it is judged whether the tip position of the bucket 1*c* found by the front posture calculation section 9*b* is within the deceleration area (refer to FIG. 9). Here, when the tip position of the bucket 1*c* is within the deceleration area, the direction conversion control section 9*e* performs deceleration control that corrects the target speed vector Vc to the target speed vector Vca by reducing the vertical vector component Vcy of the target speed vector Vc in accordance with the distance from the tip position of the bucket 1*c* to the boundary of the set area (step 612).

In step 613, it is judged whether the tip position of the bucket 1*c* found by the front posture calculation section 9*b* is outside the set area (i.e., below the boundary of the set area). Here, when it is judged that the tip position of the bucket 1*c* is outside the set area, the restitution control section 9*g* performs restitution control that corrects the target speed vector Vc to the target speed vector Vca such that the smaller the distance from the tip position of the bucket 1*c* to the boundary of the set area, the smaller the vertical vector component Vcy of the target speed vector Vc (step 614).

In step 615, the corrected target cylinder speed calculation section 9*f* or 9*h* calculates the corrected target cylinder speeds of the boom cylinder 3*a* and the arm cylinder 3*b* based on the corrected target tip speed vector found by the direction conversion control section 9*e* or the restitution control section 9*g* or based on the target tip speed vector found in step 610 if deceleration control or restitution control is not performed. Then, the target pilot pressure calculation section 9*j* calculates target pilot pressures of the pilot lines 44*a* and 44*b*, 45*a* and 45*b*, and 46*a* and 46*b* from the target cylinder speed to be output calculated by the corrected target cylinder speed calculation section 9*f* or 9*h*.

In step 616, the valve instruction calculation section 9*k* calculates instructed pressure values of the proportional solenoid valves 10*a*, 10*b*, 11*a*, 11*b*, 13*a*, and 13*b* that provide pilot pressures from the target pilot pressures calculated by the target pilot pressure calculation section 9*j*. As a result, deceleration control (direction conversion control) or restitution control is conducted, thus allowing area limiting control to be performed that forms an excavation surface along the boundary of the set area.

In step 617, the control unit 9 judges whether the engine key is on. When the engine key is still on, the control unit 9 returns to START. When the engine key is off, the control unit 9 enters zero to the flag and terminates the series of processing.

In the present embodiment configured as described above, when the estimated bucket tip speed is equal to or higher than the setting value V1, the posture of the work implement assembly 1A and the bucket tip position are calculated based on the output values from the angle sensors 8*a* to 8*c*. On the other hand, when the estimated bucket tip speed is lower than the setting value V1, the posture of the work implement assembly 1A and the bucket tip position are calculated based on the detection signals of the tilting angle sensors 81*a* to 81*c*. If the posture and position are calculated as described above, the detection signals of the angle sensors 8*a* to 8*c* are used during fast motion (equal to or higher than the setting value V1) that requires excellent responsiveness, and those of the tilting angle sensors 81*a* to 81*c* are used during slow motion (lower than the setting value V1) that requires high accuracy. As a result, the posture of the work implement assembly 1A and the bucket tip position can be calculated using detection signals of the sensor group suited to the motion speed of the bucket tip. This permits highly accurate detection of the posture and position of the work implement assembly 1A when the bucket tip moves at relatively low speed while ensuring excellent responsiveness obtained in a case where the bucket tip moves at relatively high speed, thus contributing to improved accuracy in area limiting excavation control.

In the above first to third embodiments, when the posture of the work implement assembly 1A and the positions of the respective portions are calculated based on the motion speed of at least one of the plurality of driven members making up the work implement assembly 1A, the sensors to be used for calculation are selected from two kinds of sensors, namely, the angle sensors 8*a* to 8*c* and the tilting angle sensors 81*a* to 81*c*. However, it is possible to enhance the calculation accuracy of the posture of the work implement assembly 1A and the positions of the respective portions by summing the detection signals of the two kinds of sensors as described below. A fourth embodiment will be described below.

Figure 16:
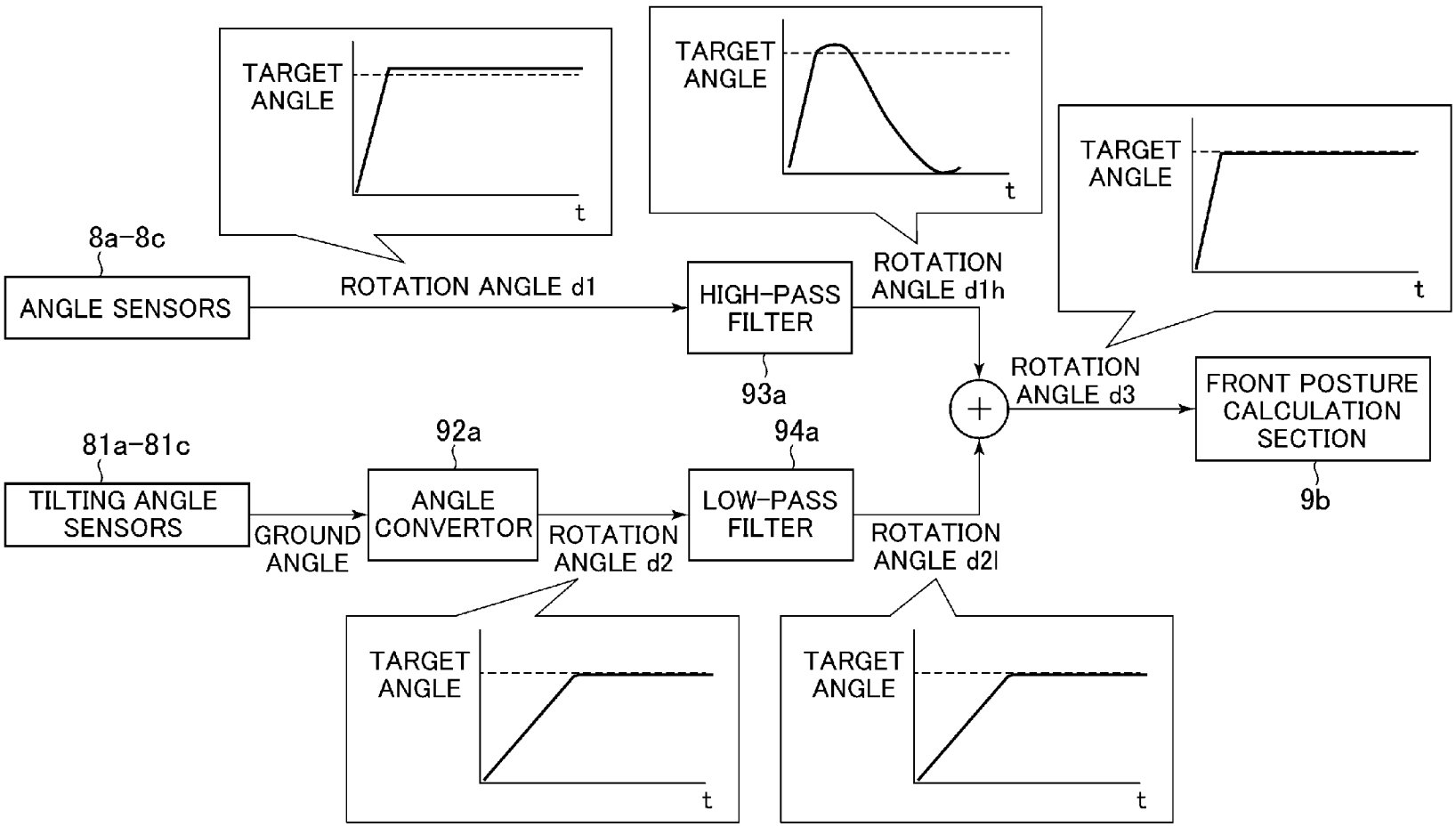
FIG. 16 is a functional block diagram illustrating some of the control functions of the control unit according to a fourth embodiment of the present invention.

FIG. 16 is a functional block diagram illustrating some of the control functions of the control unit according to the fourth embodiment of the present invention. Other components are the same as those in FIG. 5. As illustrated in FIG. 16, the control unit 9 according to the present embodiment includes a high-pass filter section 93*a* and a low-pass filter section 94*a* and a summation section 95*a*. The high-pass filter section 93*a* extracts a frequency component d1*h* that is higher than a set frequency (cutoff frequency) f1 from a detection signal (rotation angle d1) of the angle sensors 8*a* to 8*c*. The low-pass filter section 94*a* extracts a frequency component d2*l* that is lower than the set frequency f1 from a rotation angle (rotation angle d2) obtained by converting a detection signal (ground angle) of the tilting angle sensors 81*a* to 81*c* by the angle converter 92*a*. The summation section 95*a* outputs, to the front posture calculation section 9*b*, a combined signal (rotation angle d3) obtained by summing the high-frequency component d1*h* and the low-frequency component d2*l* extracted respectively by the high-pass filter section 93*a* and the low-pass filter sections 94*a*. The front posture calculation section 9*b* calculates the posture of the work implement assembly 1A and the positions of the respective portions based on the combined signal received from the summation section 95*a*.

Further, for better understanding of the combined signal, variations of different signals (rotation angles d1, d1*h*, d2, d2*l*, and d3) over time are schematically shown in FIG. 16 when a certain driven member of the work implement assembly 1A is driven to a certain target angle.

Figure 17:
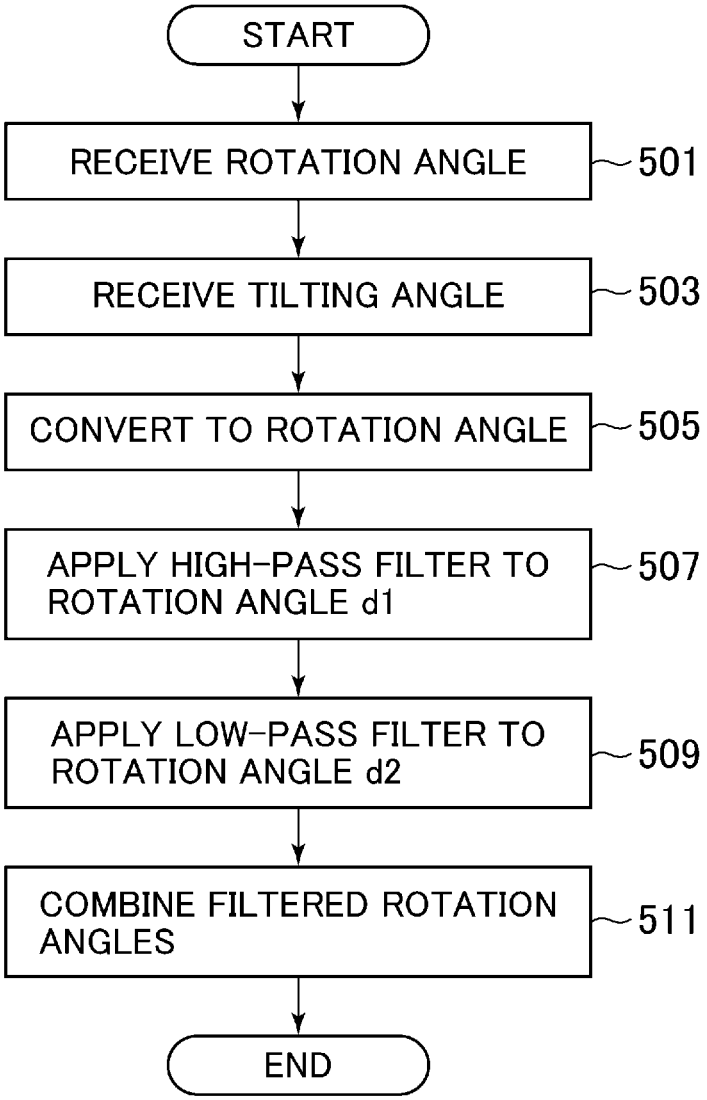
FIG. 17 is a diagram illustrating the details shown in FIG. 16 organized into a series of processing in a flowchart.

FIG. 17 is a diagram illustrating the details shown in FIG. 16 organized into a series of processing in a flowchart. At the start of the processing in FIG. 17, the control unit 9 receives a signal (rotation angle d1) of the angle sensors 8*a* to 8*c* (step 501) and a signal (ground angle) of the tilting angle sensors 81*a* to 81*c* (step 503). Then, the angle convertor 92*a* converts the signal (ground angle) received in step 504 into a rotation angle (rotation angle d2), outputting the converted angle to the low-pass filter section 94*a* (step 505).

In step 507, the high-pass filter section 93*a* passes the signal (rotation angle d1) received in step 503 through a high-pass filter, thus finding the high frequency component d1*h*. In step 509, the low-pass filter section 94*a* passes the signal (rotation angle d2) converted in step 505 through a low-pass filter, thus finding the low frequency component d2*l*. Then, the summation section 95*a* sums the high frequency component d1*h* that has passed through the high-pass filter section 93*a* and the low frequency component d1*l* that has passed through the low-pass filter section 94*a*, outputting the combined signal (rotation angle d3) obtained therefrom to the front posture calculation section 9*b* (step 511) and terminating the series of processing.

In the present embodiment configured as described above, the high frequency component d1*h* that has passed through the high-pass filter section 93*a* is a signal detected by the angle sensors 8*a* to 8*c* when the driven members move at relatively high speed. On the other hand, the low frequency component d2*l* that has passed through the low-pass filter section 94*a* is a signal detected by the tilting angle sensors 81*a* to 81*c* when the driven members move at relatively low speed or come to a halt. Therefore, if the combined signal (d3) output from the summation section 95*a* is used for posture and position calculation, the detection signal of the angle sensors 8*a* to 8*c* that offers excellent responsiveness can be used during fast motion of the driven members, and the detection signal of the tilting angle sensors 81*a* to 81*c* can be used that offers high accuracy during slow motion or halt of the driven members. This provides the same advantageous effect as those of the embodiments described earlier and permits highly accurate detection in area limiting excavation control when the work implement assembly 1A moves at relatively low speed while ensuring excellent responsiveness when the work implement assembly 1A moves at relatively high speed. It should be noted that, in the present embodiment, the high frequency component d1*h* that has passed through the high-pass filter section 93*a* is 0 during motion at constant speed. Therefore, the combined signal d3 consists of only the low frequency component d2*l* from the low-pass filter section 94*a*. As a result, the detection signal of the tilting angle sensors 81*a* to 81*c* that offers high accuracy is used regardless of the speed of the driven members.

It should be noted that common hardware components can be used among the above embodiments. Therefore, components may be selected as desired to meet computer and operator requirements including those of the control unit 9.

Further, the present invention is not limited in application to area limiting control described above. Instead, the present invention is applicable to all kinds of area limiting control tasks undertaken based on work implement assembly posture detection. Further, the approach for specifying a set area boundary is not limited to that described above. In the meantime, although a case was described above as an example where hydraulic cylinders were used as hydraulic actuators to drive the work implement assembly 1A (boom 1*a*, arm 1*b*, and bucket 1*c*), hydraulic motors, for example, may be used to drive the driven members. Further, construction machines to which the present invention is applicable are not only those that drive hydraulic pumps with an engine but also those that drive hydraulic pumps with electric motors.

It should be noted that the present invention is not limited to the above embodiment and includes various modification examples without departing from the gist of the invention. For example, the present invention is not limited to embodiments that include all the components described in the above embodiment and also includes those with some of the components omitted. Further, some of the components of one embodiment may be added to or replaced by those of other embodiment.

Still further, each of the components, functions of the components, and execution and processing of such functions, and so on may be partially or wholly implemented by hardware (i.e., designing a logic for executing each function in the form of an integrated circuit). Alternatively, each of the components of the control system may be a program (software) that implements the function of that component making up the control system as the program is read and executed by an arithmetic processing unit (e.g., CPU). Information associated with the program can be stored, for example, in a semiconductor memory (e.g., flash memory, SSD), a magnetic storage device (e.g., hard disk drive), and storage media (e.g., magnetic disks and optical disks).

DESCRIPTION OF REFERENCE CHARACTERS

1*a*: Boom
1*b*: Arm
1*c*: Bucket
2: Hydraulic pump
3*a*: Boom cylinder
3*b*: Arm cylinder
3*c*: Bucket cylinder
4*a*, 4*b*, 4*c*: Operating units
5*a*, 5*b*, 5*c*: Flow control valves
7: Setting device
8*a*, 8*b*, 8*c*: Angle sensors
9: Control unit
9*m*: Cylinder speed calculation section
91*a*: Detection signal selection section
92*a*: Angle convertor
9*b*: Front posture calculation section
9*a*: Area setting calculation section
9*c*: Target cylinder speed calculation section
9*d*: Target tip speed vector calculation section
9*e*: Direction conversion control section
9*f*: Corrected target cylinder speed calculation section
9*g*: Restoration control section
9*h*: Corrected target cylinder speed calculation section
9*i*: Target cylinder speed selection section
9*j*: Target pilot pressure calculation section
9*k*: Valve instruction calculation section
9*n*: Estimated bucket tip speed calculation section

93*a*: High-pass filter section
94*a*: Low-pass filter section
95*a*: Summation section
10*a*, 10*b*, 11*a*, 11*b*, 13*a*, 13*b*: Proportional solenoid valves
43: Pilot pump
60*a*, 60*b*, 61*a*, 61*b*, 62*a*, 62*b*: Pressure sensors
70*a*, 70*b*, 71*a*, 71*b*, 72*a*, 72*b*: Pressure sensors
81*a*, 81*b*, 81*c*: Tilting angle sensors

The invention claimed is:

1. An area limiting excavation control system for construction machines comprising:

a multi-joint work implement assembly configured by connecting a plurality of driven members that can each rotate about a rotating shaft provided on a joint;

a plurality of hydraulic actuators each adapted to drive one of the plurality of driven members to rotate about the rotating shaft;

a plurality of operating units each adapted to give a motion instruction to one of the plurality of hydraulic actuators in accordance with a operation amount thereof;

a plurality of flow control valves each driven in response to an operation signal output in accordance with the operation amount of one of the plurality of operating units to control a flow rate and a flow direction of a hydraulic fluid supplied to one of the plurality of hydraulic actuators; and a control unit configured to execute an area limiting control which controls at least one of a driving direction and a driving speed of at least one of the plurality of hydraulic actuators based on the operation amount of each of the plurality of operating units and a posture and a position of each of the driven members such that the closer a distance from a boundary of a set area within which a tip portion of the work implement assembly can move, to the tip portion to zero, the closer a speed vector component of the tip portion perpendicular to the boundary to zero, the area limiting excavation control system further comprising:

a first sensor group consisting of a plurality of sensors for detecting rotation angles of the plurality of driven members relative to the respective rotating shafts, respectively; and a second sensor group consisting of a plurality of sensors for detecting tilting angles of the plurality of driven members relative to a reference plane, respectively, the control unit configured to select, during execution of the area limiting control, from among the first sensor group and the second sensor group, a sensor to use for calculating a posture and a position of each of the plurality of driven members, in accordance with a magnitude of speed of at least one of the plurality of driven members.

2. The area limiting excavation control system for construction machines according to claim 1, wherein during execution of the area limiting control, the control unit calculates:

a posture and a position of each of the plurality of driven members based on a detection signal of the first sensor group when the magnitude of speed of the tip portion of the work implement assembly is equal to or larger than a setting value; and a posture and a position of each of the plurality of driven members based on a detection signal of the second sensor group when the magnitude of speed of the tip portion of the work implement assembly is smaller than the setting value.

3. The area limiting excavation control system for construction machines according to claim 1, wherein, during execution of the area limiting control, the control unit uses:

the detection signal of the first sensor group to calculate a posture and a position of one of the plurality of driven members, a magnitude of speed of the one of the plurality of driven members being equal to or larger than the setting value; and the detection signal of the second sensor group to calculate a posture and a position of one of the plurality of driven members, a magnitude of speed of the one of the plurality of driven members being smaller than the setting value.

4. The area limiting excavation control system for construction machines according to claim 1, wherein the plurality of driven members are connected in series relative to the construction machine main body as a base point, during execution of the area limiting control, the control unit uses:

the detection signal of the first sensor group to calculate a posture and a position of a fast motion member of the plurality of driven members, a magnitude of speed of the fast motion member being equal to or higher than the setting value, and to calculate postures and positions of other all of the plurality of driven members connected farther away, in terms of a link, from the machine main body than the fast motion member; and the detection signal of the second sensor group to calculate postures and positions of the remaining ones of the plurality of driven members.

5. An area limiting excavation control system for construction machines comprising:

a multi-joint work implement assembly configured by connecting a plurality of driven members that can each rotate about a rotating shaft provided on a joint;

a plurality of hydraulic actuators each adapted to drive one of the plurality of driven members to rotate about the rotating shaft;

a plurality of operating units each adapted to give a motion instruction to one of the plurality of hydraulic actuators in accordance with a operation amount thereof;

a plurality of flow control valves each driven in accordance with an operation signal output in response to the operation amount of one of the plurality of operating units to control a flow rate and a flow direction of a hydraulic fluid supplied to one of the plurality of hydraulic actuators;

a first sensor group consisting of a plurality of sensors for detecting rotation angles of the plurality of driven members relative to the respective rotating shafts, respectively;

a second sensor group consisting of a plurality of sensors for detecting tilting angles of the plurality of driven members relative to a reference plane, respectively;

a high-pass filter section configured to extract a frequency higher than a set frequency from each of detection signals of the first sensor group;

a low-pass filter section configured to extract a frequency lower than the set frequency from each of detection signals of the second sensor group; and a control unit configured to execute an area limiting control which controls at least one of a driving direction and a driving speed of at least one of the plurality of hydraulic actuators based on a posture and a position of one of the plurality of driven members calculated from a combined signal of signals including a signal that has passed through the high-pass filter section and a signal that has passed through the low-pass filter section, and based on the operation amount of one of the plurality of operating units such that the closer a distance from a boundary of a set area within which a tip portion of the work implement assembly can move, to the tip portion to zero, the closer a speed vector component of the tip portion perpendicular to the boundary to zero.

* * * * *